United States Patent [19]

Kozuka

[11] Patent Number: 5,005,053

[45] Date of Patent: Apr. 2, 1991

[54] IMAGE-FORMING MACHINE HAVING A PROCESS ASSEMBLY COMPRISING TWO INDEPENDENTLY MOVABLE UNITS

[75] Inventor: Nobuhiko Kozuka, Suita, Japan

[73] Assignee: Mita Industrial Co., Ltd., Osaka, Japan

[21] Appl. No.: 475,826

[22] Filed: Feb. 6, 1990

[30] Foreign Application Priority Data

Feb. 15, 1989 [JP] Japan ..... 1-33660

[51] Int. Cl.[5] ..... G03G 15/06

[52] U.S. Cl. ..... 355/245; 355/200

[58] Field of Search ..... 355/200, 245, 210, 211, 355/260

[56] References Cited

U.S. PATENT DOCUMENTS

| | | | |
|---|---|---|---|
| 4,470,689 | 9/1984 | Nomura et al. | 355/211 |
| 4,575,221 | 3/1986 | Onoda et al. | 355/211 X |
| 4,607,941 | 8/1986 | Honda | 355/210 |
| 4,609,276 | 9/1986 | Mitzutani | 355/210 |
| 4,862,212 | 8/1989 | Tanzawa et al. | 355/260 X |
| 4,926,219 | 5/1990 | Hirasawa et al. | 355/200 X |

FOREIGN PATENT DOCUMENTS

| | | | |
|---|---|---|---|
| 0061859 | 4/1984 | Japan | 355/210 |
| 0088559 | 4/1989 | Japan | 355/210 |

*Primary Examiner*—A. T. Grimley
*Assistant Examiner*—Nestor R. Ramirez
*Attorney, Agent, or Firm*—Beveridge, DeGrandi & Weilacher

[57] ABSTRACT

An image-forming machine includes a supporting structure and a process unit to be mounted on the supporting structure. The supporting structure has a lower frame member and an upper frame member mounted on the lower frame member so as to be free to pivot between an open position and a closed position. The process unit has a first unit which includes a developing device and a second unit which includes an image-bearing means with an electrostatographic material. The first unit is mounted on the upper frame member, and the second unit is mounted on the lower frame member.

18 Claims, 20 Drawing Sheets

IMAGE-FORMING MACHINE HAVING A PROCESS ASSEMBLY COMPRISING TWO INDEPENDENTLY MOVABLE UNITS

FIELD OF THE INVENTION

This invention relates to an image-forming machine such as a laser beam printer or an electrostatic copying machine.

DESCRIPTION OF THE PRIOR ART

Image-forming machines such as a laser beam printer and an electrostatic copying machine have been widely used for the formation of images on the surface of a sheet material such as recording paper. An image-forming machine of this type generally comprises an image-bearing means such as a rotating drum, a developing device for developing a latent electrostatic image formed on the surface of the image-bearing means to a toner image, a transfer means disposed in an image transfer zone, and a conveying mechanism for conveying a sheet material through the transfer zone.

The conventional image-forming machine, however, has various problems that have to be solved.

(1) Owing to the difference in service life between the image-bearing means and the developing device, the developing device is wastefully discarded.

(2) Light comes into the process unit through an opening defined in its unit frame, and tends to degrade the lightsensitive material (electrostatographic material) of the image-bearing means partly.

(3) The structure of the image-forming machine is complex in relation to a cover member for opening and closing the opening of the unit frame.

(4) For example, when the process unit is lifted, the cover member for opening and closing the opening of the unit frame is likely to move into an open position.

(5) A process unit including the image-bearing means and an optical unit for projecting light having an image information onto the image-bearing means are difficult to set in a predetermined positional relation.

(6) In a corona discharger having a grid, the wire cannot be replaced and cleaned easily owing to the presence of the grid in a discharge opening.

(7) When the developing device is removed from the image-forming machine and placed on the surface of a table, for example, the developer held inside gathers on one side, and this gathering will make it impossible to obtain the desired developing action when the developing device is then mounted on the image-forming machine and the developing operation is carried out.

SUMMARY OF THE INVENTION

It is a first object of this invention to provide an improved image-forming machine in which the image-bearing means and the developing device can be used without being discarded until they substantially come to the end of their service lives, the upper frame member can be easily opened and closed, and a jamming sheet material can be easily removed.

It is a second object of this invention to provide an improved image-forming machine in which the partial degradation of the lightsensitive material by external light can be effectively prevented.

A third object of this invention is to provide an improved image-forming machine in which a cover member for opening and closing an opening defined in the unit frame can be accurately held at a closed position by a relatively simple structure.

A fourth object of the invention is to provide an improved image-forming machine in which the opening of the cover member can be accurately hampered when the process unit is in the lifted state.

A fifth object of the invention is to provide an improved image-forming machine in which the process unit and the optical unit can be set accurately in a predetermined positional relation.

A sixth object of this invention is to provide an improved image-forming machine in which the wire can be replaced and cleaned easily in a corona discharger having a grid.

A seventh object of this invention is to provide an improved developing device in which the gathering of a developer to one side which occurs when the device is placed on the surface of a table or the like can be prevented.

DETAILED DESCRIPTION OF PREFERRED EMBODIMENTS

With reference to the accompanying drawings, the invention will be described with reference to a laser beam printer as one specific example of the image-forming machine of this invention. The following description can be equally applied to an electrostatic copying machine and other image-forming machines.

OUTLINE OF LASER BEAM PRINTER

Figure 1:
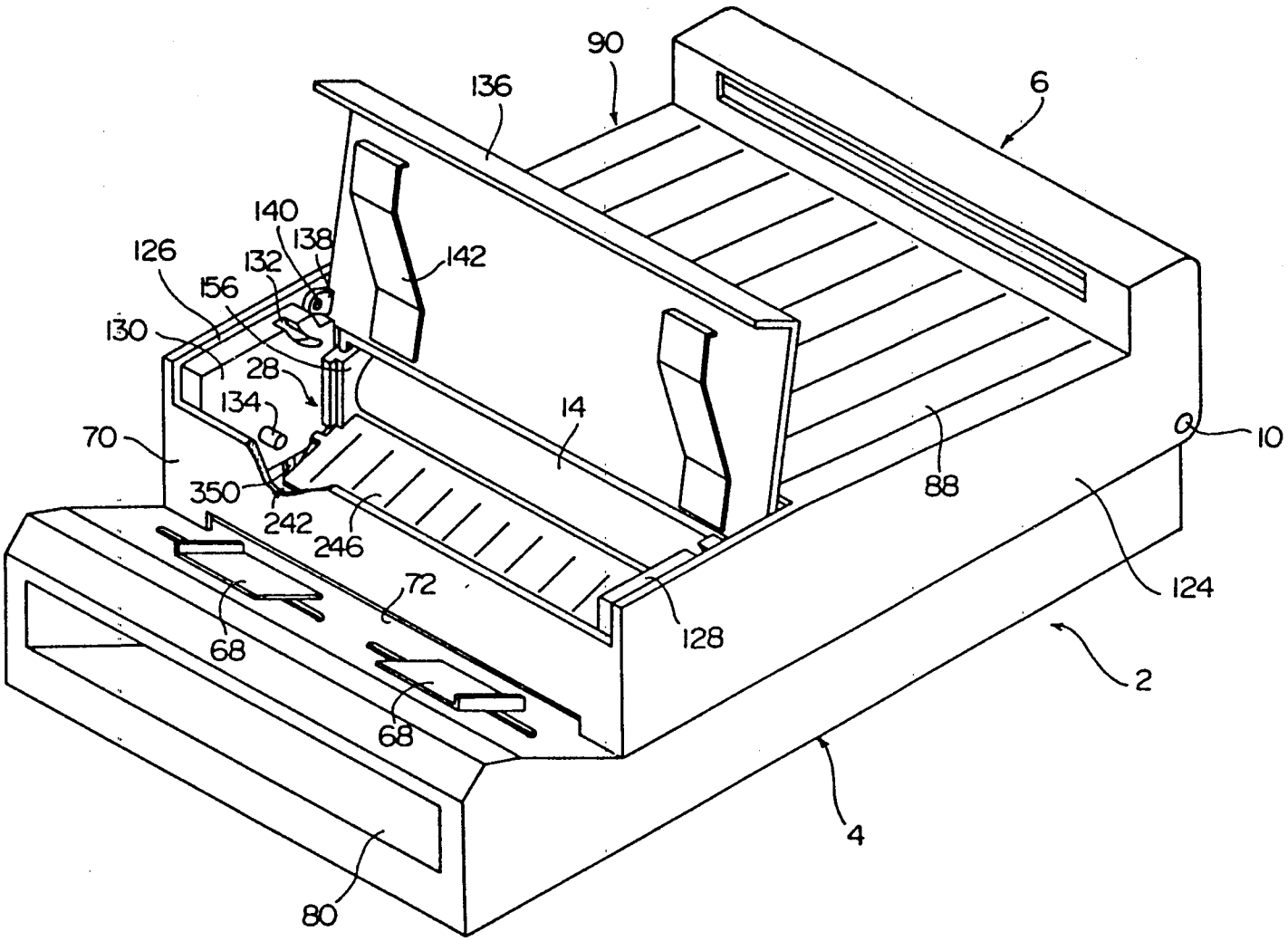
FIG. 1 is a perspective view, partly broken away, of a laser beam printer as one specific example of the image forming machine of the invention.
Figure 2:
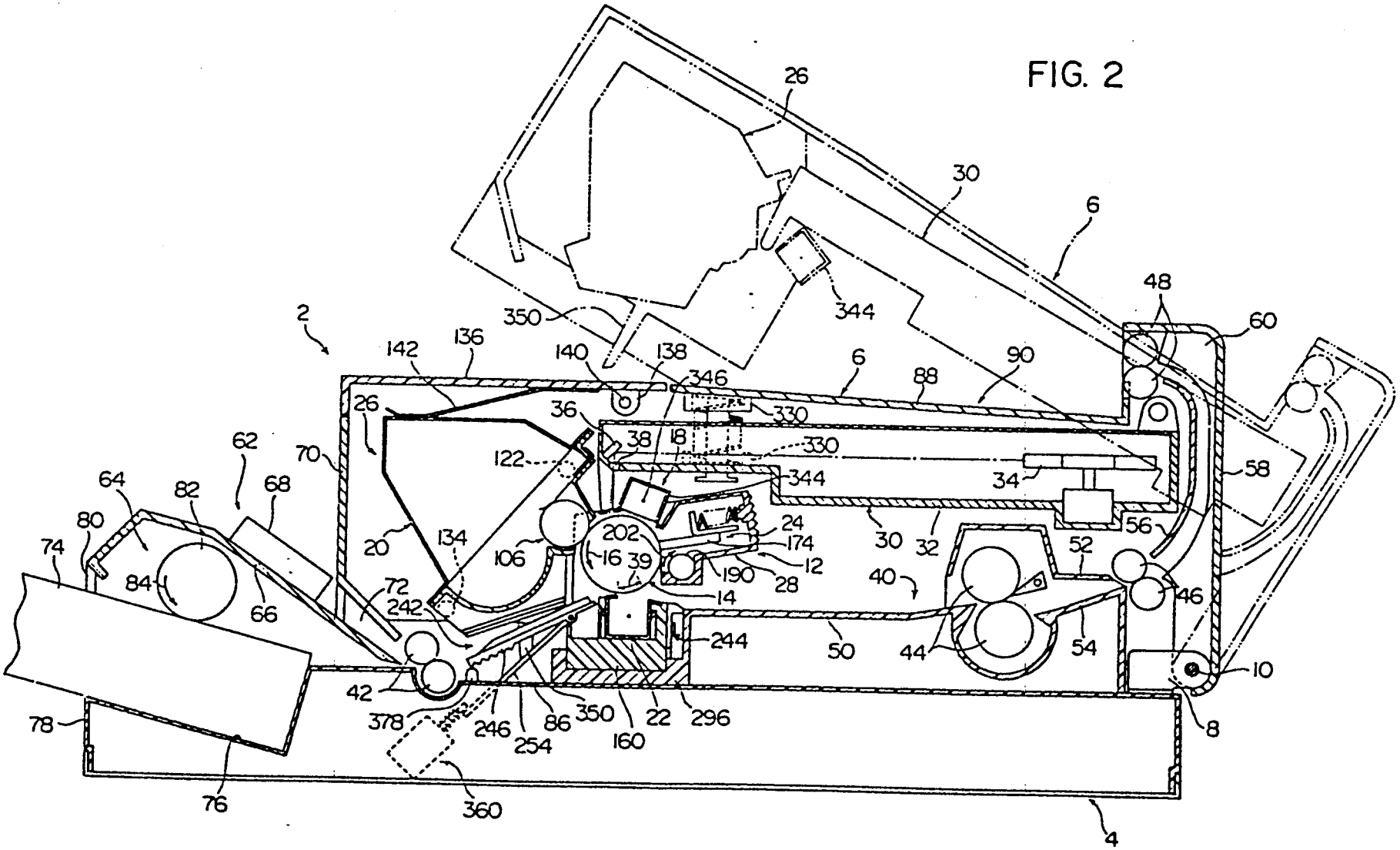
FIG. 2 is a simplified sectional view of the laser beam printer of FIG. 1.

With reference to FIGS. 1 and 2, the laser beam printer as one example of the image-forming machine has a nearly parallelpipedal main body 2. As can be seen from FIG. 2, the main body 2 of the laser beam printer is provided with a shell-type supporting structure comprised of a lower frame member 4 to be placed on the upper surface of a table or the like and an upper frame member 6 to be pivotably mounted on the lower frame member 4. A pair of brackets 8 (only one of which is shown in FIG. 2) spaced from each other in a direction perpendicular to the sheet surface are provided in the right end portion in FIG. 2 of the lower frame member 4, and the right end portion of the upper frame member 6 are mounted on the brackets 8 via a shaft member 10 (constituting a substantially horizontally extending pivot axis) so that it is free to pivot between a closed position shown in FIG. 1 and by a solid line in FIG. 2 and an open position shown by a one-dot chain line in FIG. 2.

A process unit shown generally at 12 is disposed in the left portion in FIG. 2 of the main body 2. The process unit 12 has a rotating drum 14 constituting image-bearing means, and an electrostatographic material is disposed on the peripheral surface of the rotating drum 14. Around the rotating drum 14 are disposed a charging corona discharger 18, a developing device 20, a transfer corona discharger 22 and a cleaning device 24 in this order as viewed in the rotating direction shown by an arrow 16. The process unit 12 is provided with a first unit 26 and a second unit 28. The first unit 26 includes the developing device 20, and the second unit 28 includes the rotating drum 14, the transfer corona discharger 22 and the cleaning device 24. The process unit 12 will be described in greater detail hereinbelow.

An optical unit 30 is disposed above the process unit 12. The optical unit 30 has a box-like optical housing 32 having enclosed therein a laser light source (not shown), a correcting lens (not shown), a rotating polygon mirror 34, an $f\theta$ lens (not shown), a reflecting mirror 36, and a cylindrical lens (not shown). On the basis of image information from a computer, for example, the laser light source projects laser light toward the rotating polygon mirror 34. The light reflected at the rotating polygon mirror 34 is reflected by the reflecting mirror 36 as shown by a two-dot chain line, and then projected onto the surface of the rotating drum 14 in a projecting zone through an opening 38 formed in the optical housing 32.

Below the process unit 12 is disposed a conveying mechanism 40 for conveying a sheet material through a transfer zone 39 existing between the rotating drum 14 and the transfer corona discharger 22. The conveying mechanism 40 includes a conveyor roller pair 42, a fixing roller pair 44, a conveyor roller pair 46 and a discharge roller pair 48 which define a conveying passage through which a sheet material such as recording paper is conveyed. A guiding portion 50 is provided between the transfer zone 39 and the fixing roller pair 44, and an upper guiding portion 52 and a lower guiding portion 54 are provided between the fixing roller pair 44 and the conveyor roller pair 46, and between the conveyor roller pair 46 and the discharge roller pair 48 a guiding plate 56 and a plurality of guiding flanges 60 (only one flange 60 is shown in FIG. 2) are provided. It will be understood from FIG. 2 the conveyor roller pair 42, the guiding portion 50, the fixing roller pair 44, the upper guiding portion 52 and the lower guiding portion 54 are provided in the lower frame member 4, while the guiding plate 56, the guiding flanges 60 (provided as a unit in the inside surface of a wall 58 defining the right surface), and the discharge roller 48 are provided in the upper frame member 6.

A hand-insertion feed means 62 and an automatic feed means 64 are disposed in the upstream end of the conveying passage. The left end portion in FIG. 2 of the lower frame member 4 projects to the left from the upper frame member 6, and an upper wall portion 66 provided in the projecting portion functions as a table for the hand-insertion feed means 62. A pair of width restricting members 68 spaced from each other in a direction perpendicular to the sheet surface in FIG. 2 are disposed on the upper surface of the upper wall portion 66 (see FIG. 1 also). The pair of width restricting members 68 are drivingly connected to each other by wires or the like so that when one width restricting member 68 is moved inwardly (or outwardly), the other width restricting member 68 is also moved inwardly (or outwardly). When the pair of the width restricting members 68 are held at a predetermined position and then a sheet material is moved to the right in FIG. 2 along the pair of width restricting members 68, the sheet material is conducted to the conveyor roller pair 42 through an opening 72 defined between the upper wall portion 66 of the lower frame member 4 and the lower end of the wall 70 of the upper frame member 6. The automatic feed means 64 is provided with a rectangular cassette 74 in which sheet material are loaded. A cassette receiving portion 76 is provided in the left end portion (the lower space of the upper wall portion 66) of the lower frame member 4, and the cassette 74 is loaded detachably into the cassette-receiving section 76 through an opening 80 formed in the wall 78 (wall defining the left surface in FIG. 3) of the lower frame member 4. Since the lower surface of the cassette-receiving section 76 is defined by a partitioning wall 86, the cassette-receiving section 76 can be simplified in structure. A feed roller 82 is disposed above the cassette-receiving section 76. When the feed roller 82 is revolved in the direction shown by an arrow 84, the uppermost sheet material in the cassette 74 is delivered by the action of the feed roller 82, and the delivered sheet material is conducted to the conveyor roller pair 42 after passing between the partitioning wall 86 and the upper wall portion 66 in the lower frame member 4.

The operation of the laser beam printer described above will be generally described.

When the rotating drum 14 is rotated in the direction shown by arrow 16, and during this rotation, the charging corona discharger 18 applies a corona discharge to the surface of the electrostatographic material of the rotating drum 14 to charge the surface of the electrostatographic material to a specific polarity. Then, in the projecting zone, light having image information from the laser light source (not shown) of the optical unit 30 is projected onto the electrostatographic material. As a result, a latent electrostatic image corresponding to the image information is formed on the surface of the electrostatographic material. Then, the developing device 20 applies a toner to the surface of the electrostatographic material to develop the latent electrostatic image to a toner image. The toner image so formed is then transferred to a sheet material such as recording paper in the transfer zone 39. The sheet material fed from the hand-insertion feed means 62 or the automatic feed means 64 is fed toward the transfer zone 39 by the action of the conveyor roller pair 42, and is brought into intimate contact with the rotating drum 14 in the transfer zone 39. The transfer corona discharger 22 applies a corona discharge to the back surface of the sheet material, and by the action of the transfer corona discharger 22, the toner image on the surface of the electrostatographic material is transferred to the sheet material The sheet material having the toner image transferred thereto is peeled from the rotating drum 14, and guided by the guiding portion 50 and conducted to the fixing roller pair 44. By the action of the fixing roller pair 44, the toner image is fixed to the surface of the sheet material. The sheet material having the fixed toner image is conducted downstream and passed between the upper guiding portion 52 and the lower guiding portion 54 and conveyed to the conveyor roller pair 46. It is further passed between the guiding plate 56 and the guiding flanges 60 and conveyed to the discharge roller pair 48, and by the action of the discharge roller pair 48, discharged onto a receiving portion 90 defined by the upper wall 88 of the upper frame member 6. The rotating drum 14 continues to rotate further and by the action of the cleaning device 24, the toner remaining on the electrostatographic material is removed.

FIRST UNIT

Figure 3:
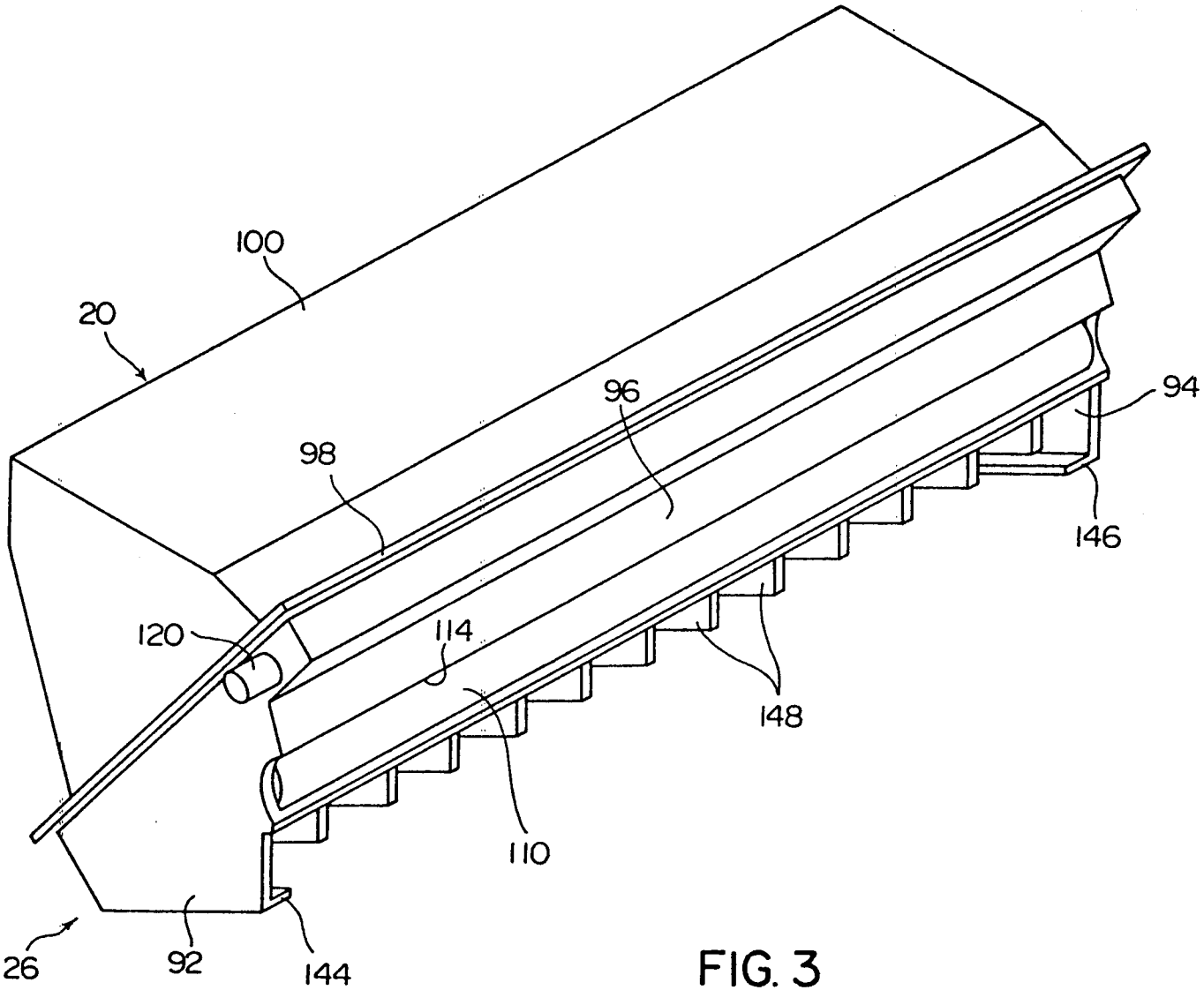
FIG. 3 is a perspective view showing a first unit of the laser beam printer of FIG. 1.
Figure 4:
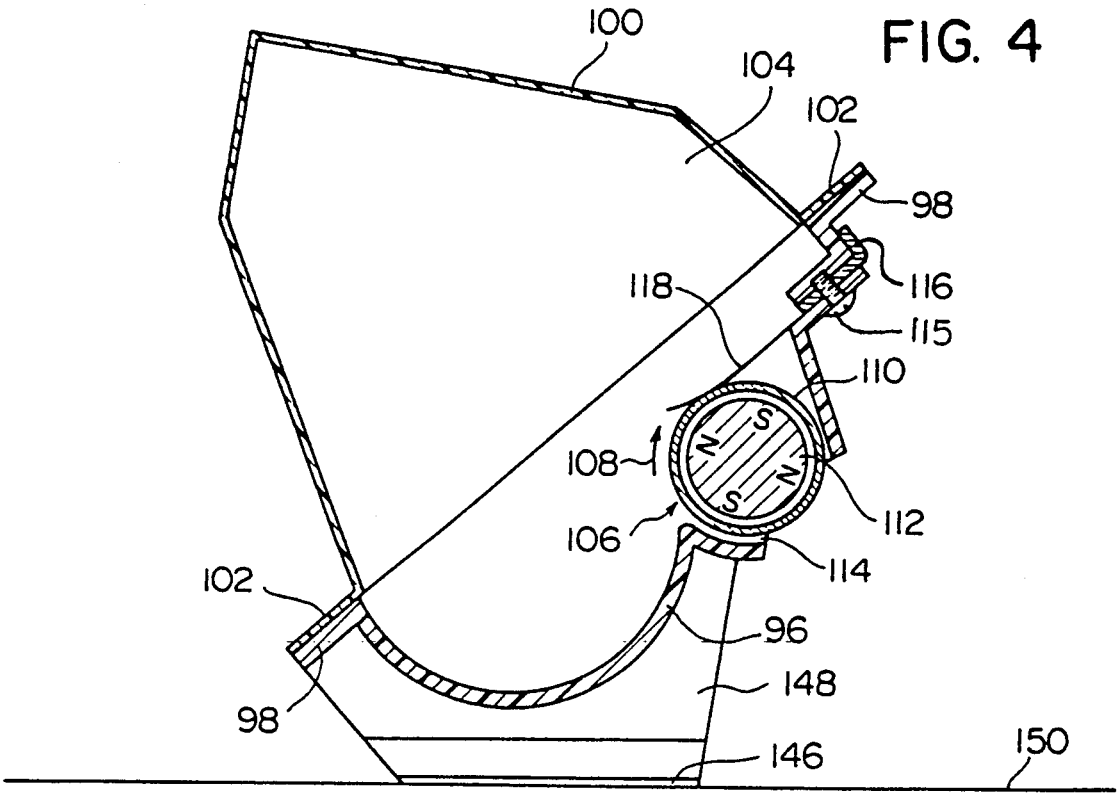
FIG. 4 is a sectional view of the first unit of FIG. 3.

With reference to FIGS. 3 and 4 taken in conjunction with FIGS. 1 and 2, the first unit 26 in the process unit 12 will be described. The first unit 26 is provided with a pair of nearly triangular end walls 92 and 94 spaced from each other in a direction perpendicular to the sheet surface in FIGS. 2 and 4 (the direction from left bottom to right top in FIG. 3). The pair of end walls 92 and 94 also function as end walls of the developing device 20, and a side wall 96 is provided between the end walls 92 and 94. The end walls 92 and 94 and the upper end of the side wall 96 define a rectangular opening, and an outwardly projecting flange 98 is provided in the opening portion. The developing device 20 is also provided with an upper housing 100. The under surface of the upper housing 100 is opened in a rectangular form, and an outwardly projecting flange 102 is also provided in the opening portion. By fixedly securing the under surface of the flange 102 to the upper surface of the flange 98 by means of an adhesive or otherwise, the upper housing 100 is bonded to the end walls 92 and 94 and the upper end of the side wall 96. The upper housing 100, the end walls 92 and 94 and the side wall 96 define a developer holding chamber 104 for holding a one-component developer composed of a toner. A magnetic brush mechanism 106 is disposed in the right end portion in FIG. 4 of the developer holding chamber 104.

With reference mainly to FIG. 4, the magnetic brush mechanism 106 has a hollow sleeve 110 to be rotated in the direction shown by an arrow 108 and a stationary permanent magnet 112 disposed in the hollow sleeve 110. A portion of the magnetic brush mechanism 106 slightly projects externally through an opening 114 formed in the side wall 96. The surface of the hollow sleeve 110 desirably has a surface roughness of 0.5 to 5 μm, preferably (2±L) μm. A nearly L-shaped fixture member 116 is attached to the side wall 96 by means of a fixing screw 115, and a blade 118 is fixed to the fixture member 116. The blade 118 may be made of an elastic metal plate, and its free end portion extends toward the hollow sleeve 110 and is held is press contact with its surface. Because of this construction, a developer held in the developer holding chamber 104 is magnetically held onto the surface of the hollow sleeve 110 by the action of the stationary permanent magnet 112, and the developer so held is conveyed in the direction shown by an arrow 108 by the rotation of the hollow sleeve 110. The developer so conveyed undergoes the action of the blade 118 and the excess of the developer is removed from the surface of the hollow sleeve 110 by the blade 118 to form a thin layer of the developer having a thickness of 30 to 100 μm on its surface. On the other hand, the developer held onto the hollow sleeve 110 is conveyed in the direction of arrow 108, and applied to the surface of the electrostatographic material of the rotating drum 14 through the opening 114 formed in the side wall 96. Consequently, the latent electrostatic image on the surface of the electrostatographic material is developed to a toner image (see FIG. 2 as well).

With regard to the first unit 26, the process unit is further constructed as described below. Again, with reference to FIGS. 1 to 4, outwardly projecting supporting pins 120 and 122 are provided on the outside surfaces of the end walls 92 and 94 (in FIG. 3, the supporting pin 120 provided in the end wall 92 is shown, and in FIG. 2, the supporting pin 122 provided in the end wall 94 is shown). The upper frame member 6 also has vertical side walls 124 and 126 (see FIG. 13 also) spaced from each other in a direction perpendicular to the sheet surface in FIG. 2 (the direction from right bottom to left top in FIG. 1). Rectangular block members 128 and 130 (FIG. 1) are attached respectively to the inside surfaces of the vertical side walls 124 and 126. Arcuate receiving portions 132 (FIG. 1 shows only one which is defined in the block member 130) corresponding to the supporting pins 120 and 122 of the first unit 26 are formed in the inside surfaces of the block members 128 and 130. Inwardly projecting supporting pins 134 (FIGS. 1 and 2 shows only that provided in the block member 130) are provided respectively in the inside surfaces of the block members 128 and 130. The left portion of the upper surface of the upper frame member 6 is open, and an upper opening-closing cover 136 is provided in the opening portion. A pair of protrusions 138 (one of which is shown in FIGS. 1 and 2) are provided in one end portion of the opening-closing cover 136, and these protrusions 138 are pivotably mounted via a pin 140. Accordingly, the upper opening-closing cover 136 is free to pivot between the closing position shown in FIG. 2, and the opening position shown in FIG. 1. When the upper opening-closing cover 136 is held at the closing position, its other end portion (slightly projecting downwardly) makes contact with the upper edge of the wall 70, and the pivoting movement of the cover beyond the closing position is hampered. When the cover 136 is held at the opening position, part of it makes contact with the left end in FIG. 2 of the upper wall 88, and the pivoting movement of the cover 136 beyond the opening position is hampered. Desirably, a locking means (Not shown) for releasably locking the cover 136 at the closing position is provided. A pair of elastic plates 142 spaced from each other are fixed to the inside surface of the cover 136. The elastic plates may be formed of a plate spring, for example. One end portion of each plate 142 is fixed to the inside surface of the cover 136, and its free end portion extends downwardly to the left in FIG. 2.

The first unit 26 is detachably mounted on the upper frame member 6 in a manner to be described.

While the upper opening-closing cover 136 is held at the open position, the supporting pins 120 and 122 provided in the end walls 92 and 94 are inserted into the corresponding receiving portions through the open upper surfaces, and positioned at the bottom parts of the receiving portions 132. As a result, the first unit 26 is supported between the vertical side walls 124 and 126 of the upper frame member 6 in such a manner that it is free to pivot about the supporting pins 120 and 122. It will be easily understood from FIG. 2 that in this supported state, the first unit 26 is biased counterclockwise in FIG. 2 by the own weight of the developing device 20 and rollers (not shown) attached to both axial end portions of the hollow sleeve 110 make contact with both end portions of the rotating drum 14. Thus, when the first unit 26 is mounted in this state, the developing device 20 is supported as shown in FIG. 2. In this state, the pair of supporting pins 134 do not come into contact with the end walls 92 and 94, and some space exists between the supporting pins 134 and the flanges 98. Then, when the cover 136 is brought to the closed position from the open position and held there, the elastic plate 142 provided on the inside surface of the cover 136 acts on the upper surface of the upper housing 100 of the developing device 20, and by the elastic action of the elastic plate 142, the rollers (not shown) provided in the hollow sleeve 110 are brought into press contact with the rotating drum 14 to hold the developing device 20 accurately at the position shown in FIG. 2. The distance between the hollow sleeve 110 of the developing device 20 and the rotating drum 14 is maintained accurately at a fixed value determined by the rollers. When the upper frame member 6 is pivoted from the closed position to the open position with the first unit 26 mounted on the upper frame member 6, the rollers (not shown) of the developing device 20 are moved away from the rotating drum 14. Consequently, the developing device 20 is pivoted slightly counterclockwise in FIG. 2 about the supporting pins 120 and 122, and the flanges 98 provided in the end walls 92 and 94 come into contact with the supporting pins 134. While the flanges 98 are in contact with the supporting pins 134, the first unit 26 is pivoted upwardly incident to the pivoting movement of the upper frame member 6. The first unit 26 may be detached from the upper frame member 6 by lifting the first unit 26 while the cover 136 is held at the open position, and detaching the supporting pins 120 and 122 from the receiving portions 132.

In the developing device 20 shown in the drawings, the lower end portions (acting as supporting protrusions) of the end walls 92 and 94 project downwardly beyond the side wall 96, and inwardly projecting portions 144 and 146 are provided in these projecting lower ends. A plurality of guiding ribs 146 spaced from each other in a direction perpendicular to the sheet surface in FIGS. 2 and 4 (the direction from left bottom to right top in FIG. 3) are provided in the under surface of the side wall 96. The amounts of projection of the ribs 148 are substantially the same, and the lower end portions of the end walls 92 and 94 project further downwardly beyond the lower ends of the ribs 148. Accordingly, when the developing device 20 is mounted in position, the lower edges of the ribs 148 define part of the upper surface of a conveyor passage for conducting a sheet material toward the transfer zone 39, and it is not necessary to provide a guiding member for exclusive use in this site. When the developing device 20 is detached from the upper frame member 6 and positioned on a surface 150 of a table or the like, the projecting portions 144 and 146 provided in the end walls 92 and 94 are placed on the surface 150, and the lower edges of the ribs 148 do not make contact with the surface 150. Hence, very rarely, the lower edges of the ribs 148 are contaminated by contact with the surface 150, and this prevents contamination of the sheet material Furthermore, when the developing device 20 is placed on the surface 150, the developing device 20 is maintained in substantially the same state as it is mounted on the main body 2 of the machine, and the developer held in the developer holding chamber 104 is prevented from leaning to one side.

In the illustrated embodiment, the lower ends of the end walls 92 and 94 project downwardly beyond the ribs 148, but instead of this structure, the amounts of projection of the lower ends of the end walls 92 and 94 and the amounts of projection of the lower ends of the ribs 148 may be made substantially the same. In this construction, the lower end portions of the end walls 92 and 94 and the ribs 148 function as a guide for guiding the sheet material, and as a supporting portion when they are placed on the surface 150. Because the ribs 148 function as a supporting portion their lower edges are susceptible to contamination, and the sheet material is liable to undergo contamination.

SECOND UNIT

Now, the second unit 28 in the process unit 12 will be described with reference to FIGS. 5 to 8.

The second unit 28 includes a unit frame 152 to be mounted on the lower frame member 4. The unit frame 152 is provided with a pair of end walls 154 and 156 spaced from each other in a direction perpendicular to the sheet surface in FIGS. 2 and 6 (the direction from left bottom to right top in FIGS. 5, and the left-right direction in FIGS. 7 and 8). The upper surface and under surface of the unit frame 152 and its right surface in FIG. 6 are covered with an upper wall 158, a bottom wall 160 and a side wall 162, respectively.

The rotating drum 14 and the cleaning device 24 are mounted between the end walls 154 and 156 in a manner to be described.

Figure 8:
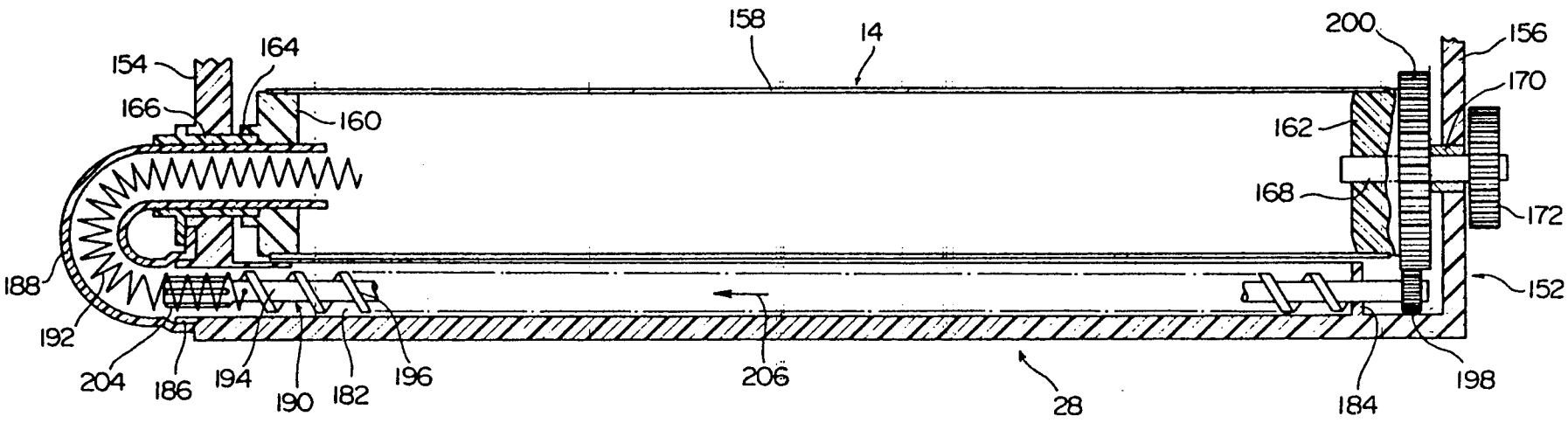
FIG. 8 is a sectional view of the principal parts of the second unit of FIG. 5 as they are viewed from above.

With reference mainly to FIG. 8, the rotating drum 14 has a hollow cylindrical drum body 158 which may be formed of, for example, an aluminum alloy, and an electrostatographic material is disposed on the peripheral surface of the drum body 158. End wall members 160 and 162 are attached to opposite ends of the drum body 158. An annular flange 164 is provided in the end wall member 160, and rotatably supported on one end portion of a supporting sleeve 166 mounted through the end wall 154. A shaft member 168 is fixed to the end wall member 162 and rotatably supported on the end wall 156 via a bearing member 170. One end portion of the shaft member 168 projects outwardly through the end wall 156, and to this projecting end portion is mounted a gear 172. When the second unit 28 is mounted on the lower frame member 4 as described below, the gear 172 is drivingly connected to a gear (not shown) driven by a driving source of the main body 2 of the machine. Thus, the rotating drum 14 is rotated in the direction of arrow 16 (FIG. 2).

Figure 6:
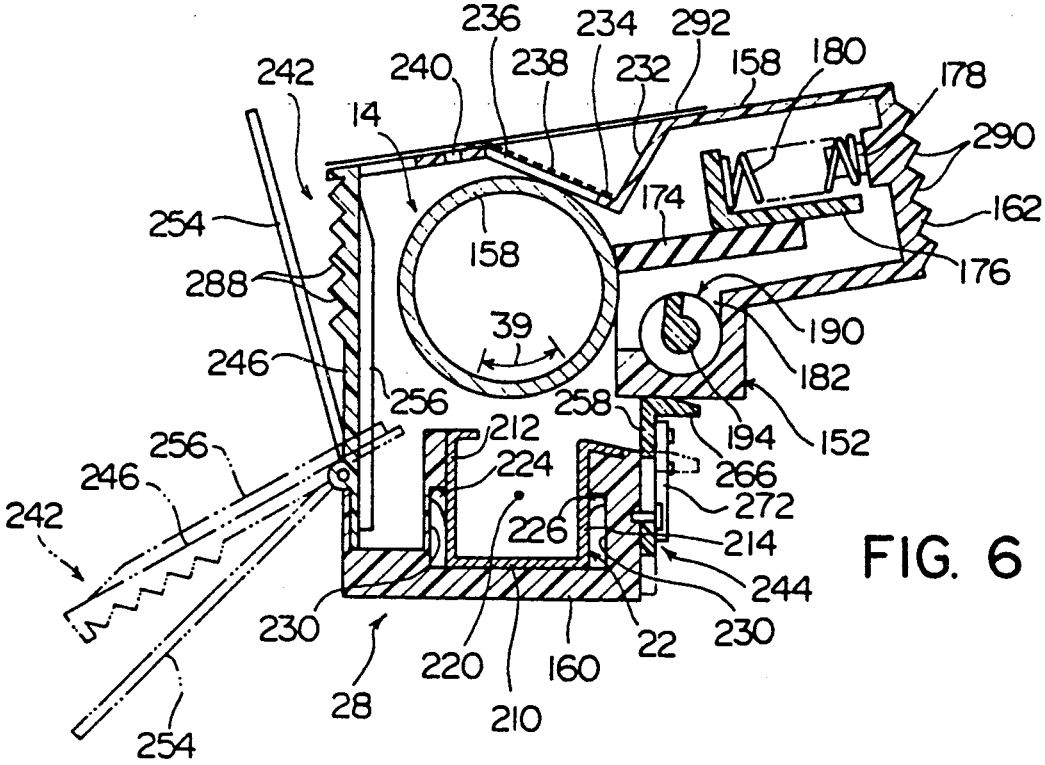
FIG. 6 is a sectional view of the second unit of FIG. 5.

With reference to FIG. 6 also, the right upper end portion in FIG. 6 of the unit frame 152 projects to the right, and the cleaning device 24 is disposed in a space created by this projection. The cleaning device 24 is provided with an elastic blade 174 which can be formed, for example, from synthetic rubber. One end portion of the elastic blade 174 is fixed to a nearly L-shaped fixture member 176, and the fixture member 176 is mounted between the end walls 154 and 156 so that it is free to move toward and away from the rotating drum 14. A pair of spaced supporting protrusions 178 (FIG. 7) are provided in the inside surface of the upper end portion of the right side wall 162 of the unit frame 152. One end portion of a biasing coil spring 180 is mounted on the supporting protrusions 178, and its other end portion is adapted to act on the fixture member 176. Accordingly, the biasing coil spring 180 biases the fixing member 176 to the left in FIG. 6 toward the rotating drum 14, and the free end portion of the elastic blade 174 is brought into press contact with the rotating drum 14 under a predetermined pressure. A toner recovery chamber 182 is defined below the elastic blade 174. The toner recovery chamber 182 is defined by the bottom of the projecting portion of the right side wall 162 and a projecting wall 184 (FIG. 8) provided in the inside surface of the right side wall 162. The toner removed from the rotating drum 14 by the action of the elastic blade 174 is let fall into the toner recovery chamber 182 and recovered.

The toner recovered in the toner recovery chamber 182 is adapted to be transferred to the internal space of the drum body 158 of the rotating drum 14. A circular opening is formed in a predetermined site of the end wall 154, and an outwardly projecting annular flange 186 is provided in this opening portion. One end portion of a nearly Ushaped hollow member 188 is connected to the flange 186. The other end portion of the hollow member 188 projects into the internal space of the drum body 158 through the supporting sleeve 166 and the end wall member 160. A first transfer member 190 is disposed at the bottom of the toner recovery chamber 182 of the cleaning device 24. A second transfer member 192 is disposed in the hollow member 188. The first transfer member 190 has a shaft portion 194 extending between the end walls 154 and 156, and a helical protrusions 196 for transferring the toner is provided in the peripheral surface of the shaft portion 194. One end portion of the shaft portion 194 projects to the right in FIG. 8 through the projecting wall 184, and a small gear 198 is mounted on the projecting end portion. As shown in FIG. 8, a large gear portion 200 is provided integrally in the end wall member 162 of the rotating drum 14, and the small gear 198 is directly connected drivingly to the large gear portion 200. Accordingly, when the rotating drum 14 is rotated in the direction of arrow 16, the first transfer member 190 is rotated in the direction shown by an arrow 202 (FIG. 2) via the large gear portion 200 and the small gear 198. One end portion of the second transfer member 192 is connected to the other end portion of the first transfer member 190. In the illustrated embodiment, the second transfer member 192 is formed of a coil-like member, and its one end portion is fitted over a plurality of protruding lines 204 provided in the other end portion of the shaft portion 194, and one end is connected to the other end of the shaft portion 194. The other end of the second transfer member 192 projects from the other end of the hollow member 188 into the space of the drum body 158. Because of this construction, when the first transfer member 190 is rotated in the direction of arrow 202 as above, the second transfer member 192 accordingly rotates also. Thus, the toner recovered in the toner recovery chamber 182 is transferred in the direction shown by an arrow 206 (FIG. 8), passed in the hollow member 188, and recovered in the internal space of the rotating drum. With regard to the recovery of the toner to be discarded in the rotating drum 14, it is preferable to set the volume of the internal space of the rotating drum 14 at a value larger than the amount of the toner to be discarded which is formed until the electrostatographic material substantially comes to the end of its service life, and to accurately recover the toner to be discarded which is formed until the electrostatographic material substantially comes to the end of its service life in the internal space of the rotating drum 14.

The transfer corona discharger 22 is mounted on the bottom wall 160 of the unit frame 152 in a manner to be described.

Figure 9:
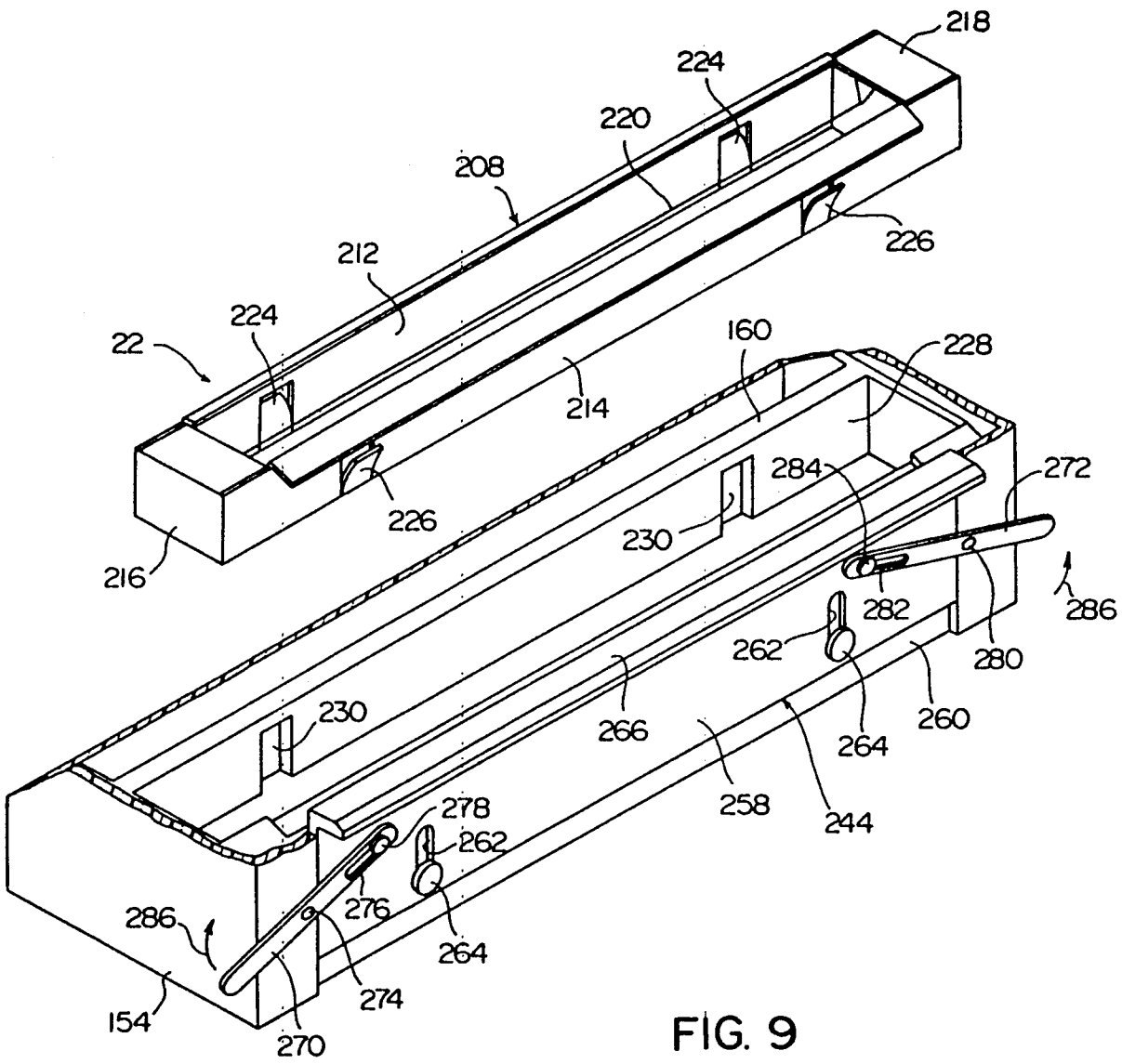
FIG. 9 is a perspective view showing the lower portion of the unit frame in the second unit of FIG. 5 and a transfer corona discharger.

With reference to FIGS. 6 and 9, the illustrated transfer corona discharger 22 is provided with an elongated metallic housing 208, and the housing 208 has a bottom wall 210 and side walls 212 and 214 extending upwardly from both side ends of the bottom wall 210. Insulating block-like members 216 and 218 that may be formed from a synthetic resin, for example, are mounted on both end portions of the housing 208, and a wire 220 is stretched taut between the block-like members 216 and 218. One end of the wire 220 is electrically connected to a terminal 222 (FIG. 10) fixed to the block-like member 216. The upper end portion of the side wall 212 is bent to the right in FIG. 6 in the transferring direction of the sheet material, and conducts the sheet material toward the transfer zone 39. The upper end portion of the side wall 214 is also bent to the right in FIG. 6 in the transferring direction of the sheet material, and conducts the sheet material peeled from the rotating drum 14 further downstream. A pair of longitudinally spaced elastic pieces 224 and 226 are provided in the side walls 212 and 214. The pair of elastic pieces 224 and 226 are formed by breaking the side walls 212 and 214 partly, and bending them arcuately outwardly. A slender rectangular receiving portion 228 is formed in the bottom wall 160 of the unit frame 152 in correspondence to the housing 208. In the illustrated embodiment, a projecting portion is provided in part of the bottom wall 160 in order to secure enough depth for the receiving portion 228, and four depressed portions are formed in correspondence to the elastic pieces 224 and 226 in predetermined sites in the wide surface of the receiving portion 228 (two such depressed portions are shown in FIGS. 6 and 9). Because of this construction, the housing 208 is substantially entirely received in the receiving portion 228 as shown in FIG. 6 by inserting the housing 208 of the transfer corona discharger 22 from above into the receiving portion 228 defined in the bottom wall 160. Furthermore, the elastic pieces 224 and 226 provided in the housing 208 are positioned in the corresponding depressed portions 230 formed in the receiving portion 228 and slightly inwardly deformed elastically. Accordingly, it will be easily seen that by the slight elastic deformation of the elastic pieces 224 and 226, the housing 208 is accurately held at the position shown in FIG.

6, and the upper ends of the elastic pieces 224 and 226 make contact with the upper surface of the depressed portion 230 the detachment of the transfer corona discharger 22 from the receiving portion 228 can be accurately prevented. As shown in FIG. 6, a depression is formed in part of the opening portion of the receiving portion 228 provided in the bottom wall 160, when the housing 208 is positioned in the receiving portion 228, the bent upper end portion of the side wall 214 is adapted to be positioned in the above-described depression.

Figure 5:
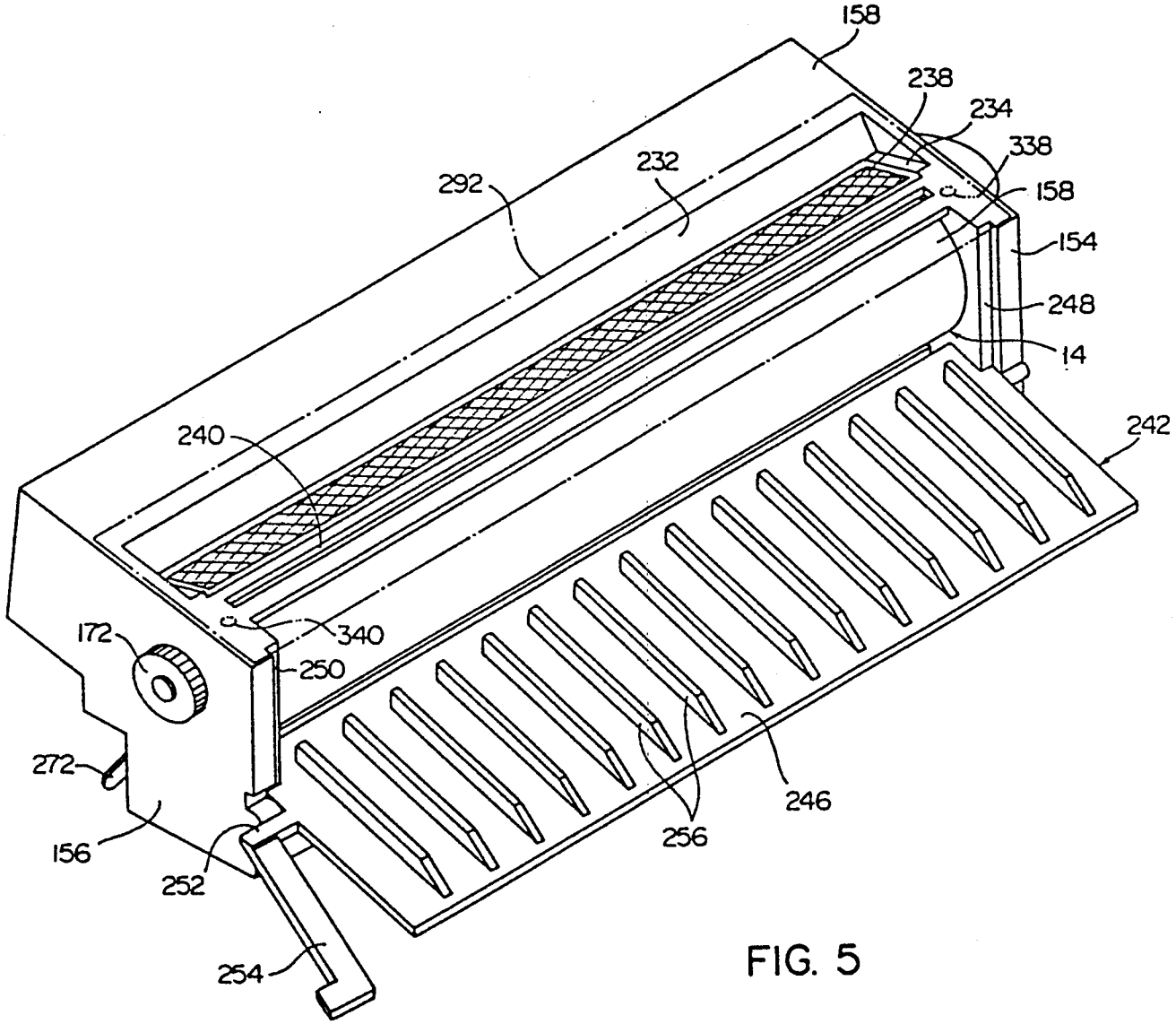
FIG. 5 is a perspective view showing a second unit in the laser beam printer of FIG. 1.
Figure 7:
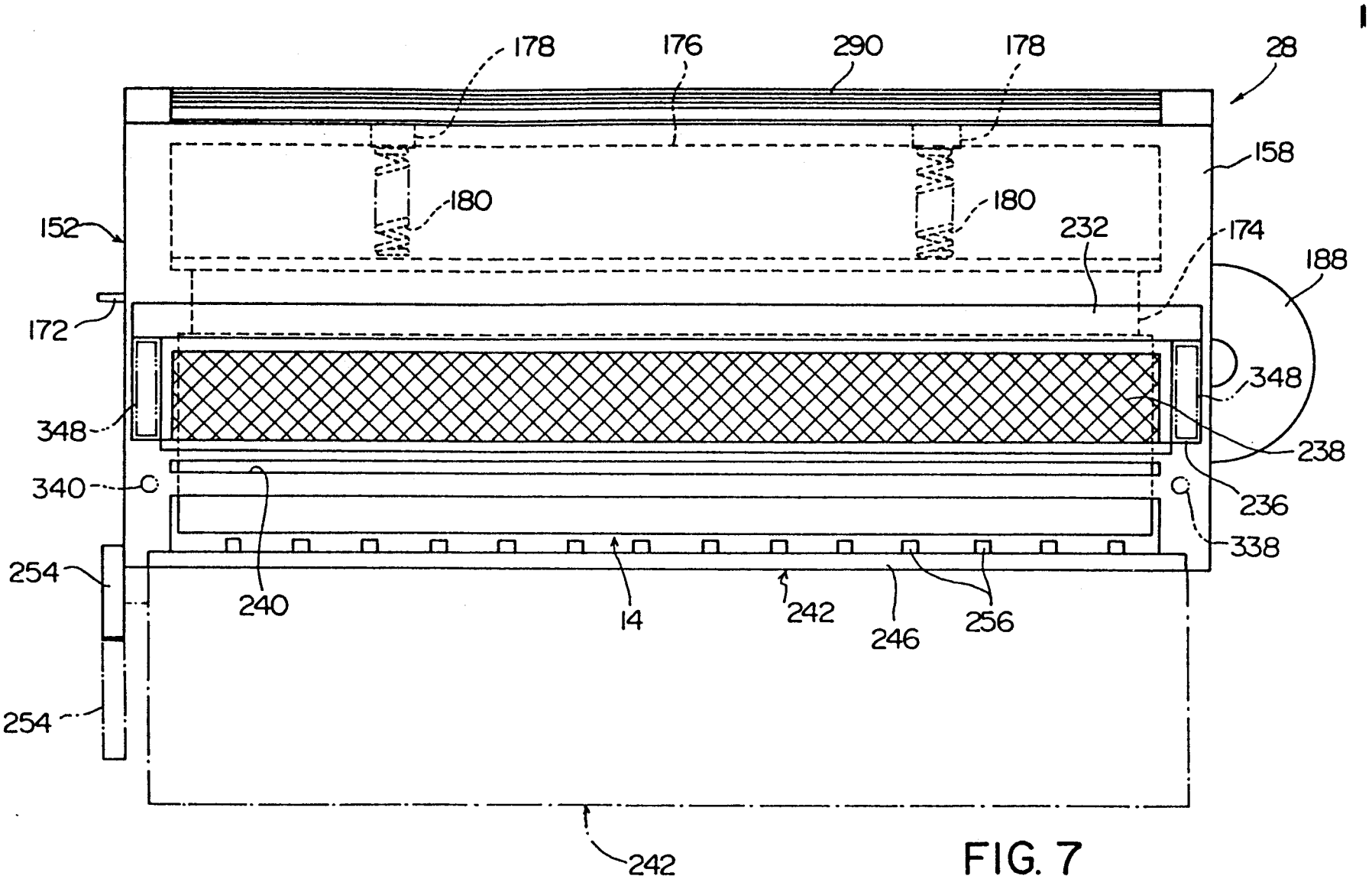
FIG. 7 is a top plan view of the second unit of FIG. 5.

With reference mainly to FIGS. 5 to 7, a nearly triangular depressed portion is formed by inclined walls 232 and 234 in the nearly central part in the left-right direction in FIG. 6 of the upper wall 158 of the unit frame 152. A slender opening 236 is formed nearly entirely throughout the inclined wall 234, and a grid 238 of the charging corona discharger 18 is disposed in the opening 236. The grid 238 may be formed of a metallic mesh material. An exposure opening 240 slender in the axial direction of the rotating drum 14 is formed in the left end portion in FIG. 6 of the upper wall 158. Laser light having image information from the laser light source (not shown) is projected onto the electrostatographic material of the rotating drum 14 through this exposure opening 240.

Again, with reference to FIGS. 2, 5, 6 and 9, a major portion of the left surface in FIGS. 2 and 6 of the unit frame 152 and part of the right surface in FIGS. 2 and 5 of the unit frame 152 are open. The opening defined in the left surface of the unit frame 152 acts as an opening for introducing the sheet material into the transfer zone 39. Furthermore, through this opening, the developer held on the magnetic brush mechanism 106 of the developing device 20 acts on the peripheral surface of the rotating drum 14. The opening defined in the right surface of the unit frame 152 acts as an opening for withdrawing the sheet material conveyed through the transfer zone 39. In the illustrated embodiment, a cover 242 is provided for opening and closing the introduction opening defined in the left surface of the unit frame 152. Also provided is a cover 244 for opening and closing the withdrawing opening defined in the right surface of the unit frame 152. These opening-closing covers 242 and 244 are preferably formed of an insulating material such as a synthetic resin when they define part of the conveying passage as will be stated below. With reference mainly to FIGS. 5 and 6, the cover 242 has a rectangular cover body 246, and both ends of the lower end portion of the cover body 246 are pivotably connected to the end walls 154 and 156 of the unit frame 152. Stepped portions 248 and 250 are provided in the right end in FIG. 5 of the end walls 154 and 156, and both end portions of the cover body 246 are adapted to be positioned at the stepped portions 248 and 250. A biasing spring (not shown) for biasing the cover body 246 clockwise in FIG. 6 is provided in the cover body 246. Hence, when both end portions of the cover body 246 make contact with the stepped portions 248 and 250, the cover body 246 is held at the closed position shown by a solid line in FIGS. 6 and 7. An outwardly projecting portion 252 is provided at one end of the cover body 246 (that end which makes contact with the end wall 156), and an arm 254 is provided as a unit in the projecting portions 252. When the upper frame member 6 is held at the closed position as will be described below, an actuating piece (to be described) attached to the upper frame member 6 acts on the arm 254 to hold the cover body 246 at the open position shown by a one-dot chain line in FIGS. 6 and 7 (also shown in FIG. 5). When the cover body 246 is at the open position, it extends inclinedly upwardly toward the transfer zone 39 in the conveying direction of the sheet material, and its upper surface defines the under side of the conveying passage for conducting the sheet material to the transfer zone 39. A plurality of guiding linear protrusions 256 (FIG. 5) spaced from each other in a direction perpendicular to the sheet surface in FIGS. 2 and 6 are provided in the upper surface of the cover body 246, and the upstream ends of these guiding linear protrusions 256 are inclined such that they conduct the sheet material to the upper surface of the guiding linear protrusions 256 from the upper surface of the cover body 246.

With reference to FIGS. 6 and 9, the cover 244 has a rectangular cover body 258. A cover securing depressed portion 260 (FIG. 9) is formed in the right surface in FIG. 6 of a projecting portion provided in the bottom wall 160 of the unit frame 152. The cover body 258 is disposed in the cover securing depressed portion 260. A pair of vertically aligned slender holes 262 are formed in the cover body 258 in spaced-apart relationship longitudinally (in the direction perpendicular to the sheet surface in FIG. 6; the direction from left bottom to right top in FIG. 9). By fixing pin members 264 to the securing depressed portion 260 through these holes 262, the cover body 258 is mounted vertically movably. Although not shown, a biasing spring for biasing the cover body 258 upwardly is provided in the cover body 258. A guiding projecting portion 266 projecting in the conveying direction of the sheet material is provided in the upper end of the cover body 258. Because of the above construction, the cover 244 is usually held at the closed position shown by a solid line in FIG. 6 (the position shown in FIG. 9) by the action of the biasing spring. At the closed position, the upper end of the cover 244 makes contact with part of the right wall 162 of the unit frame 152 (specifically, the under surface of the site defining the toner recovery chamber 182), and the pin member 264 is positioned in the lower end of the hole 262. Thus, the movement of the cover 244 beyond the closed position is accurately hampered. When the second unit frame 28 is mounted detachably on the lower frame member 4, the cover 244 is held at the open position shown by one-dot chain line in FIG. 6 by the action of an actuating mechanism (not shown). At this open position, the pin member 264 is positioned in the upper end of the hole 262, and the movement of the cover 244 beyond the open position is accurately hampered. At this open position, the guiding protrusion 266 provided at the upper end of the cover body 258 extends toward the upper surface of the guiding portion 50 from the upper surface of the projecting portion of the bottom wall 160 as shown in FIG. 2 to define the under side of part of the conveying passage for conducting the sheet material peeled from the rotating drum 14 to the fixing roller pair 44.

The operating mechanism for holding the cover 244 at the open position will be described. The actuating mechanism shown in the drawings has a pair of lever members 270 and 272. The lever member 270 is linked pivotably to the left end portion in FIG. 9 of the bottom wall 160 via a pin 274. A long hole 276 is formed in one end portion of the lever member 270 and by fixing a pin member 278 to the cover member 258 through the long hole 276, the above one end portion is pivotably connected to the cover 244 so that it is free to move over a predetermined range. The lever member 270 inclines downwardly from one end to the other, and its other end portion is slightly projects beyond the end wall 154. The lever member 272 is pivotably connected to the right end portion in FIG. 9 of the bottom wall 160 via a pin member 280. A long hole 282 is formed in one end portion of the lever member 272, by fixing a pin member 284 to the cover body 258 through the long hole 282, the above one end portion is connected pivotably to the cover 244 so that it is free to move over a predetermined range. The lever member 272 also inclines downwardly from one end toward the other, and its other end portion slightly projects beyond the end wall 156. Because of the above construction, when the lever members 270 and 272 are pivoted in the direction shown by an arrow 286, the cover 244 is moved downwardly toward the open position incident to the rotation.

In the illustrated embodiment, the second unit is further constructed as shown below. The second unit 28 can be easily lifted by holding the cover 242 and the upper projecting portion of the right side wall 162 of the unit frame 152. In this connection, a plurality of vertically spaced protrusions 288 are provided in the outside surface of the upper portion of the cover body 246 of the cover 242. Moreover, a plurality of vertically spaced protrusions 290 (see FIG. 6 also) are provided also on the outside surface of the upper projecting portion of the right side wall 162. The protruding lines 288 and 290 may be of any suitable shape which permits easy holding. In the illustrated embodiment, they are triangular in section, and in FIG. 6, extend in the direction perpendicular to the sheet surface.

By forming the second unit 28 in an easily holdable structure, the following advantage may be obtained. As will be easily understood from FIG. 6, when the cover 242 and the upper projecting portion of the right side wall 162 are held from outside, an external force resulting from holding acts in addition to the biasing force of the biasing spring (not shown) on the cover 242. Accordingly, the cover 242 is biased toward the closed position by the biasing force and the external force, and its end portions make contact with the stepped portions 248 and 250 of the end walls 154 and 156, and as a result, the cover 242 is more accurately held at the closed position. Thus, the cover 242 pivots towards the open position, and the rotating drum 14 is prevented from being exposed to the outside through the introduction opening.

As shown in FIGS. 5 and 6, the upper surface of the second unit 28 is covered with a sheetlike seal member 292 during its making. One end of the seal member 292 exists in the right portion of the upper wall 158, and its other end portion extends above the inclined walls 232 and 234 defining the depressed portion and above the exposure opening 240 and terminates at the left end in FIG. 6 of the unit frame 152. As a result, the seal member 292 covers the opening 236 formed in the inclined wall 234, the exposure opening 240 formed in the upper wall 158 and an opening existing between the left end of the upper wall 158 and the cover 242 existing at the closed position. The seal member 292 may be formed of a metallic plate, a plastic article, a resin film or paper having light-shielding property, and can be bonded to the upper surface of the upper wall 158 by means of an adhesive or an adhesive tape.

In relation to the seal member 292, the following description may be added. The left end portion in FIG. 6 of the seal member 292 extends to the cover body 246 of the cover 242 and is bonded to the end surface (the upper end surface in FIG. 6) of the cover body 246. Hence, the seal member 292 hampers the pivoting movement of the cover 242 from the closed position toward the open position, and also functions as a fixing member for fixing the cover 242 to the closed position releasably.

The seal member 292 is removed as required before starting to use the second unit 28. This leaves the opening 236 and the exposure opening 240 open, and permits pivoting of the cover 242.

MOUNTING AND DETACHING OF THE SECOND UNIT

The second unit 28 may be detachably mounted on the lower frame member 4.

Figure 10:
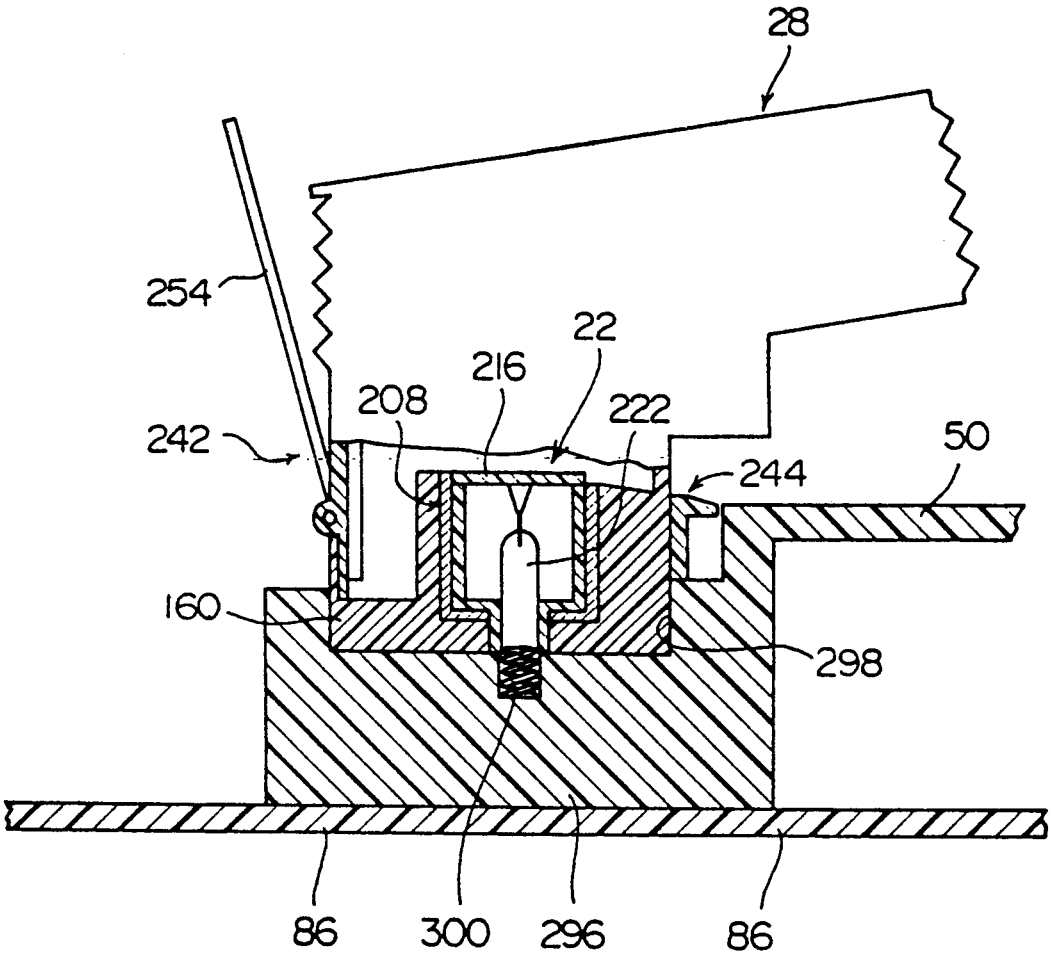
FIG. 10 is a sectional view showing the state in which the second unit is mounted on the lower frame member partly in section.
Figure 12:
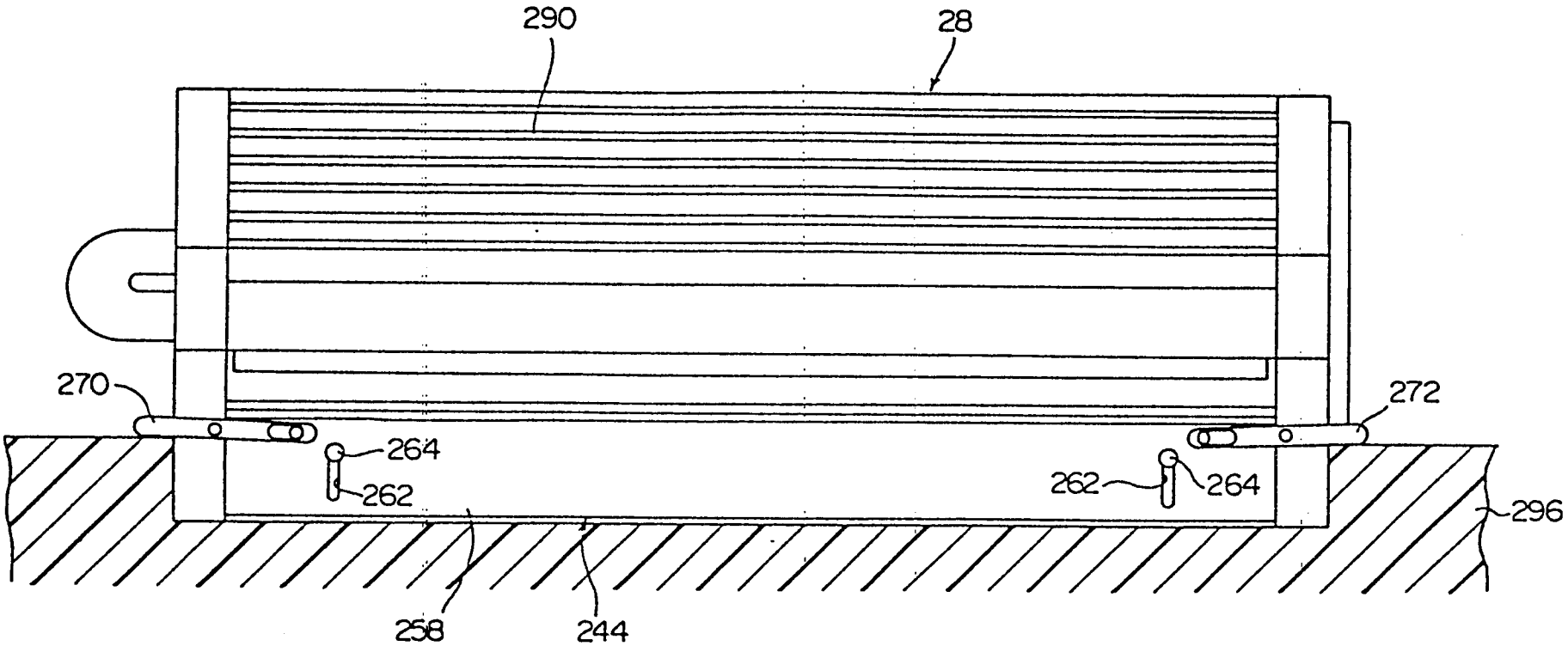

With reference mainly to FIGS. 10 and 12, a fixing block portion 296 is provided as a unit in the partitioning wall 86 of the lower frame member 4. The guiding portion 50 mentioned above extends from the fixing block portion 296. A rectangular fixing depressed portion 298 corresponding to the shape of the lower portion of the unit frame 152 of the second unit 28 is formed on the upper surface of the fixing block portion 296. A metallic coil spring 300 is mounted in correspondence to the terminal 222 of the transfer corona discharger 22 on a predetermined site of the fixing depressed portion 298. The metallic coil spring 300 is electrically connected to a high voltage corona power supply (not shown) mounted on the lower frame member 4, and its tip portion slightly projects into the fixing depressed portion 298.

Figure 11:
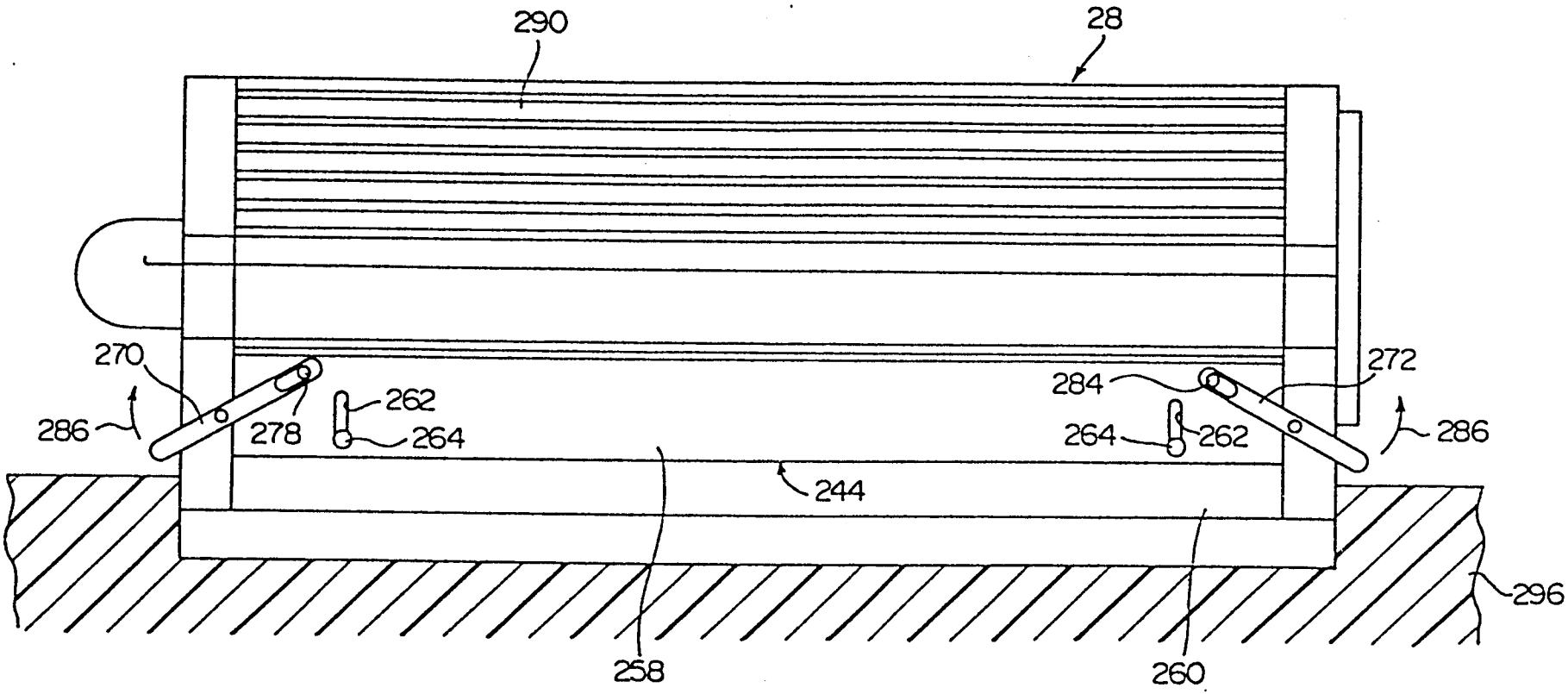
FIGS. 11 and 12 are sectional views for illustrating the actions in the mounting of the second unit on the lower frame member.

When the second unit 28 is to be mounted on the lower frame member 4, the second unit 28 is first positioned above the fixing depressed portion 298 defined in the fixing block portion 296 and then its bottom is positioned in the fixing depressed portion 298 as shown in FIG. 11. Thereafter, the second unit 28 in the state shown in FIG. 11 is moved downwardly and mounted on the fixing block portion 296 as shown in FIG. 12. When the second unit 28 is moved downwardly to the mounting position shown in FIG. 12 from the state shown in FIG. 11, the other end portions of the lever members 270 and 272 make contact with the upper surface of the fixing block portion 296 by the downward movement of the second unit 28. With the downward movement of the second unit 28, the lever members 270 and 272 are pivoted in the direction shown by arrow 286 (FIGS. 9 and 11), and accordingly, the cover 244 is moved downwardly toward the open position. When the second unit 28 is moved to the mounting position as shown in FIG. 12, the cover 244 is held at the open position via the pair of lever members 270 and 272, and as a result, the withdrawing opening defined in the unit frame 152 is opened as shown in FIG. 10. Furthermore, when the second unit is moved to the mounting position, the terminal 222 of the transfer corona discharger 22 acts on the metallic spring 300 mounted on the fixing block portion 296 as shown in FIG. 10 to elastically deform the spring slightly. Thus, by the elastic recovering force of the coil spring 300 functioning as an electrical terminal, the metallic coil spring 300 and the terminal 222 are acculatedly connected electrically. When the second unit 28 is moved to the mounting position, the lower surface of its bottom wall 160 makes contact with the fixing depressed portion 298 defined in the fixing block portion 296. As a result, the second unit 28 does not move beyond the mounting position.

Accordingly, by simply mounting the second unit 28 on the fixing block portion 296 of the lower frame member 4, the cover 244 is held at the open position from the closed position, and the terminal 222 of the transfer corona discharger 22 is electrically connected to the metallic coil spring 300 in the lower frame member 4. No special operation is necessary for opening the cover 244 and connecting the terminal 222.

On the other hand, the second unit 28 may be detached from the lower frame member 4 by holding the upper portion (specifically, the protrusions 288 provided in the cover 242 and the protrusions 290 provided in the right side wall 162) projecting from the fixing block portion 296 in the second unit 28 and lifting it to thereby detach it from the fixing block portion 296. When it is lifted as above, the terminal 222 of the corona discharger 22 separates from the metallic coil spring 300 to release electrical connection between the terminal 222 and the spring 300. Furthermore, by so doing, as the second unit 28 moves upwardly, the cover 244 moves upwardly by the action of the biasing spring (not shown). When the second unit 28 is detached from the fixing block portion 296, the cover 244 is held at the closed position.

OPTICAL UNIT AND RELATED ELEMENTS

Figure 13:
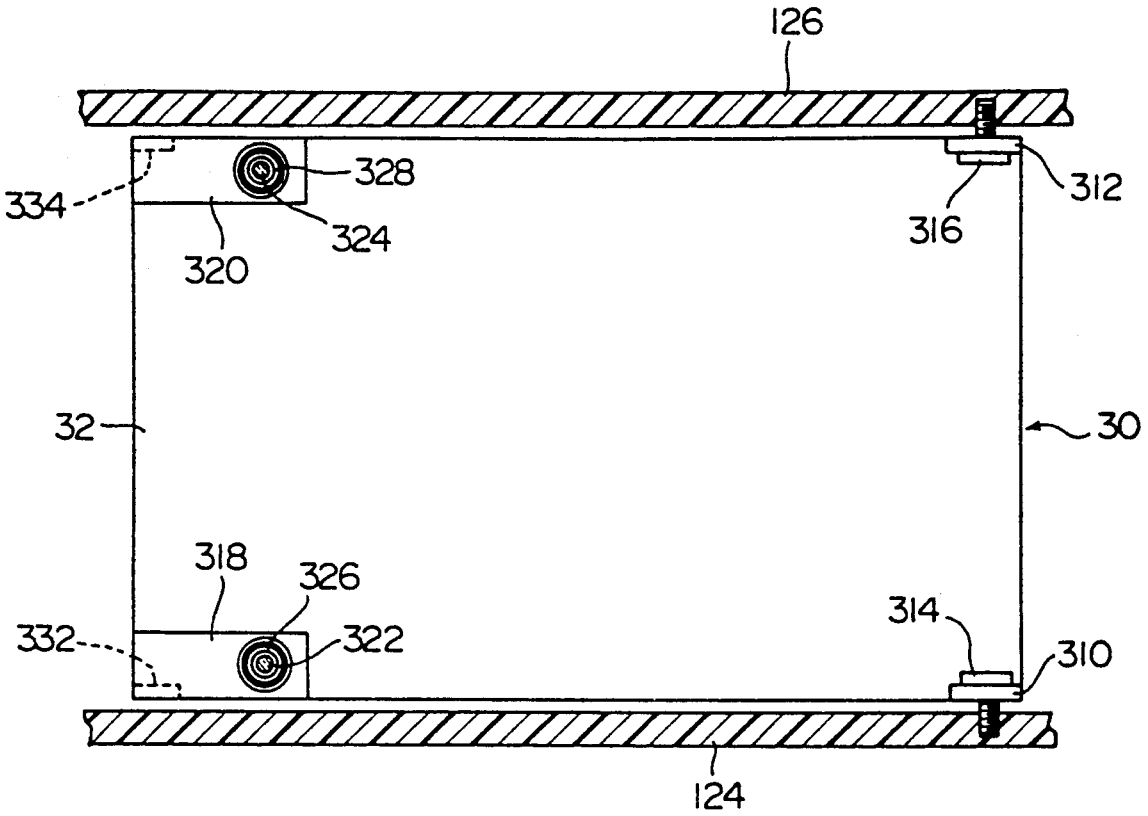
FIG. 13 is a sectional view of the optional unit and its vicinity in the laser beam printer of FIG. 1 as they are viewed from above.
Figure 14:
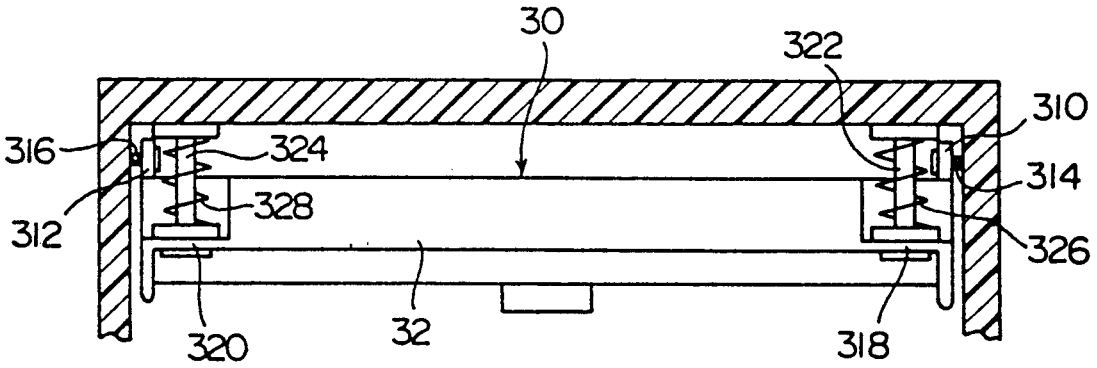
FIG. 14 is a sectional view of the optical unit and its vicinity as they are viewed sideways.

With reference to FIGS. 2, 13 and 14, the optical unit 30 and its related elements will be described.

The optical housing 32 of the optical unit 30 is nearly parallelpipedal, and its one end portion is pivotably mounted on the right end portion in FIG. 2 of the upper frame member 6. Upwardly extending portions 310 and 312 are provided as a unit in both side ends of one end portion of the optical housing 32. Pins 314 and 316 (constituting substantially horizontally extending pivot axes) are screwed into the vertical side walls 124 and 126 through holes formed in the projecting portions 310 and 312. Accordingly, the optical housing 32 is free to pivot vertically, but cannot substantially move laterally (in the direction perpendicular to the sheet surface in FIG. 2; vertically in FIG. 13; and the left-right direction in FIG. 14). No space exists at both side ends of the other end portion of the optical housing 32, and the other end portion extends in a plate-like shape. Holes (not shown) are formed in plate-like portions 318 and 320. The above-mentioned other end portion of the optical housing 32 is mounted movably over a predetermined range by threadedly fitting fixing screws 322 and 324 to the upper wall 88 of the upper frame member 6 through the above holes. Coil springs 326 and 328 (constituting biasing means) are disposed fitting over the fixing screws 322 and 324. One ends of these springs are anchored at the plate-like portions 318 and 320 and the other ends of them, at the inside surface of the upper wall 88. To holds the coil springs 326 and 328 at predetermined positions, annular receiving portions 330 are provided in the plate-like portions 318 and 320 and the upper wall 88. The coil springs 326 and 328 bias the optical housing 32 downwardly toward the second unit 12. Clearance setting protrusions 332 and 334 protruding downwardly are provided in both corner portions of the other end portions of the optical housing 32. The clearance setting protrusions 332 and 334 act to maintain the clearance between the optical unit 30 and the second unit 28 at a predetermined value, and preferably, their lower ends are formed in a hemispherical shape.

Because of the foregoing structure, the optical unit 30 is usually biased downwardly by its own weight and by the biasing action of the coil springs 326 and 328, and held at the lowered position shown in FIG. 14 by the contacting of the plate-like portions 318 and 320 with the head portions (functioning as movement hampering means) of the fixing screws 322 and 324. When the upper frame member 6 having the optical unit 30 mounted thereon is held at the closed position, the clearance setting protrusions come into contact with predetermined parts (areas 338 and 340 shown by two-dot chain lines in FIGS. 5 and 7) of the upper wall 268 of the second unit 28. As a result, the other end portion of the optical unit 30 is moved upwardly relative to the upper frame member 6 against the biasing action of the coil springs 326 and 328. Thus, the clearance between the optical unit 30 and the second unit 28 is maintained at a predetermined value set by the clearance setting protrusions 332 and 334. Furthermore, in this state, the coil springs 326 and 328 are slightly compressed (see FIG. 2) from the state shown in FIG. 14. Accordingly, the clearance setting protrusions 332 and 334 of the optical unit 30 is relatively strongly brought into press contact with the upper wall 158 of the unit frame 152. Consequently, the optical unit 30 and the second unit 28 are maintained in press contact with each other, and the clearance between them is accurately set at the predetermined value.

OTHER STRUCTURES

The charging corona discharger 18 and its related parts are constructed in the following manner. Again, with reference to FIG. 2, the charging corona discharger 18 has a slender metallic housing 344, and a wire 346 is stretched taut within the housing 344. The housing 344 is mounted detachably between the vertical side walls 124 and 126 of the upper frame member 6, and adapted to be opened and closed as a unit with the upper frame member 6. When the upper frame member 6 is at the closed position, the under surfaces of both end portions of the housing 344 come into contact with the upper surfaces of both end portions of the inclined wall 234 in the unit frame 152, namely with an area 348 shown by a two-dot chain line in FIG. 7. As a result, the charging corona discharger 18 and the rotating drum 14 are held in a predetermined positional relationship. It will be seen from FIGS. 2 and 7 that in this state, the opening defined in the under surface of the housing 344 is positioned toward the rotating drum 14, and the grid 238 mounted on the inclined wall 234 of the unit frame 152 is positioned beneath the opening of the housing 344. Hence, a corona discharge from the charging corona discharger 18 is applied to the surface of the electrostatographic material of the rotating drum 14 through the opening 236 formed in the inclined wall 234, and the applied corona discharge is controlled by the grid 238. On the other hand, when the upper frame member 6 is held at the open position, the housing 344 for the charging corona discharger 18 is moved upwardly as a unit with the upper frame member 6. It will be seen from FIG. 2 therefore that the space between the housing 344 and the grid 238 in the charging corona discharger 18 is open, and through the opening of the housing 344, the wire 346 and other parts can be easily cleaned (as required, the cleaning can be performed more easily by detaching the housing 344 from the upper frame member 6). The grid 238 is electrically connected to a terminal (not shown) provided in the fixing block 296.

In the upper frame member 6 is also provided an actuating member 350 for holding the cover 242 for the second unit 28 at the open position as the upper frame member 6 moves toward the closed position. With reference to FIGS. 15 to 18 taken in conjunction with FIG. 2, the actuating member 350 is mounted on the block member 130 (see FIG. 1 also) provided in the vertical side wall 126 of the upper frame member 6. A rectangular mounting space 352 is defined in the block member 130, and a head portion 354 provided at one end of the actuating member 350 is mounted in this space 352 so as to be free to move vertically. The other end portion of the actuating member 350 projects downwardly through part of the block member 130. The projecting lower end portion is inclined so as to act on the arm 254 of the opening closing cover 242. A biasing spring 356 is also disposed in the mounting space 352. The biasing spring 356 acts on the head portion 354 of the actuating member 350 to bias it elastically downwardly. Accordingly, the actuating member 350 is usually held at the lowered position shown in FIG. 15 by the contacting of its head portion 354 with the under surface of the mounting space 352. The actuating member 350, as will be described in detail below, acts on the arm 254 of the cover 242 to hold it at the open position. The actuating member 350 may be fixed to the upper frame member 6. But since in the specific embodiment illustrated, this manner of fixing causes some inconveniences to be described, it is kept free to move over a predetermined range. When the actuating member 350 is relatively short, the inclination of the cover 242 at the open position becomes gentle and it can be utilized as a member defining part of the conveying passage. But when the upper frame member 6 is pivoted toward the closed position, the bottom of the developing device 20 inconveniently comes into contact with the cover 242. If, on the other hand, the actuating member 350 is relatively long, the actuating member 350 comes into contact with the arm 254 at an early stage of the pivoting of the upper frame member 6. Hence, the bottom of the developing device 20 does not come into contact with the cover 242, but the inclination of the cover 242 at the open position becomes steep, and it is difficult to utilize it as a member defining part of the conveying passage.

Figure 19:
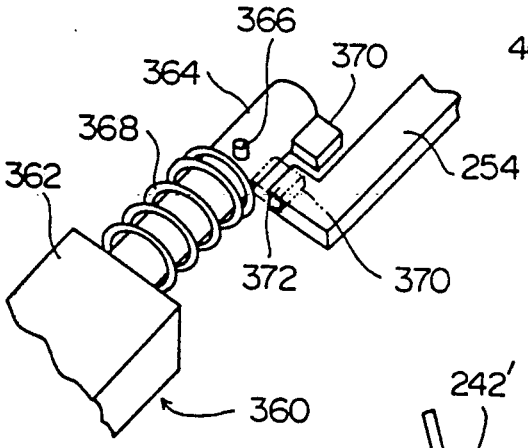
FIG. 19 is a partial enlarged view of an open position holding means and its related elements in the laser beam printer of FIG. 1.

Means for holding the cover 242 at the open position is provided in the lower frame member 4. With reference to FIG. 19 also, the illustrated open position holding means has an electromagnetic solenoid 360. The main body 362 of the solenoid is secured to a predetermined site of the lower frame member 4. An output rod 364 is movably mounted on the main body 362 of the solenoid A coil spring 368 fitting over the output rod 364 is interposed between a pin 366 forced into the output rod 364 and the main body 362 of the solenoid. In the illustrated embodiment, when the electromagnetic solenoid 360 is energized, it acts on the arm 254 of the cover 242. With reference mainly to FIG. 19, a protrusion 370 projecting to the right in FIG. 19 is provided in the forward end portion of the output rod 354, and in the forward end portion of the arm 254, a protrusion 372 projecting to the left in FIG. 19 is provided. When the electromagnetic solenoid 360 is in the deenergized state, the protrusion 370 of the output rod 364 is positioned exteriorly of the moving path of the protrusion 372 as shown by a solid line in FIG. 19 and does not engage the protrusion 372. But when the electromagnetic solenoid 360 is energized, the protrusion 370 comes into the moving path of the protrusion 372 as shown by a two-dot chain line in FIG. 19 and can engage the protrusion 372.

Figure 15:
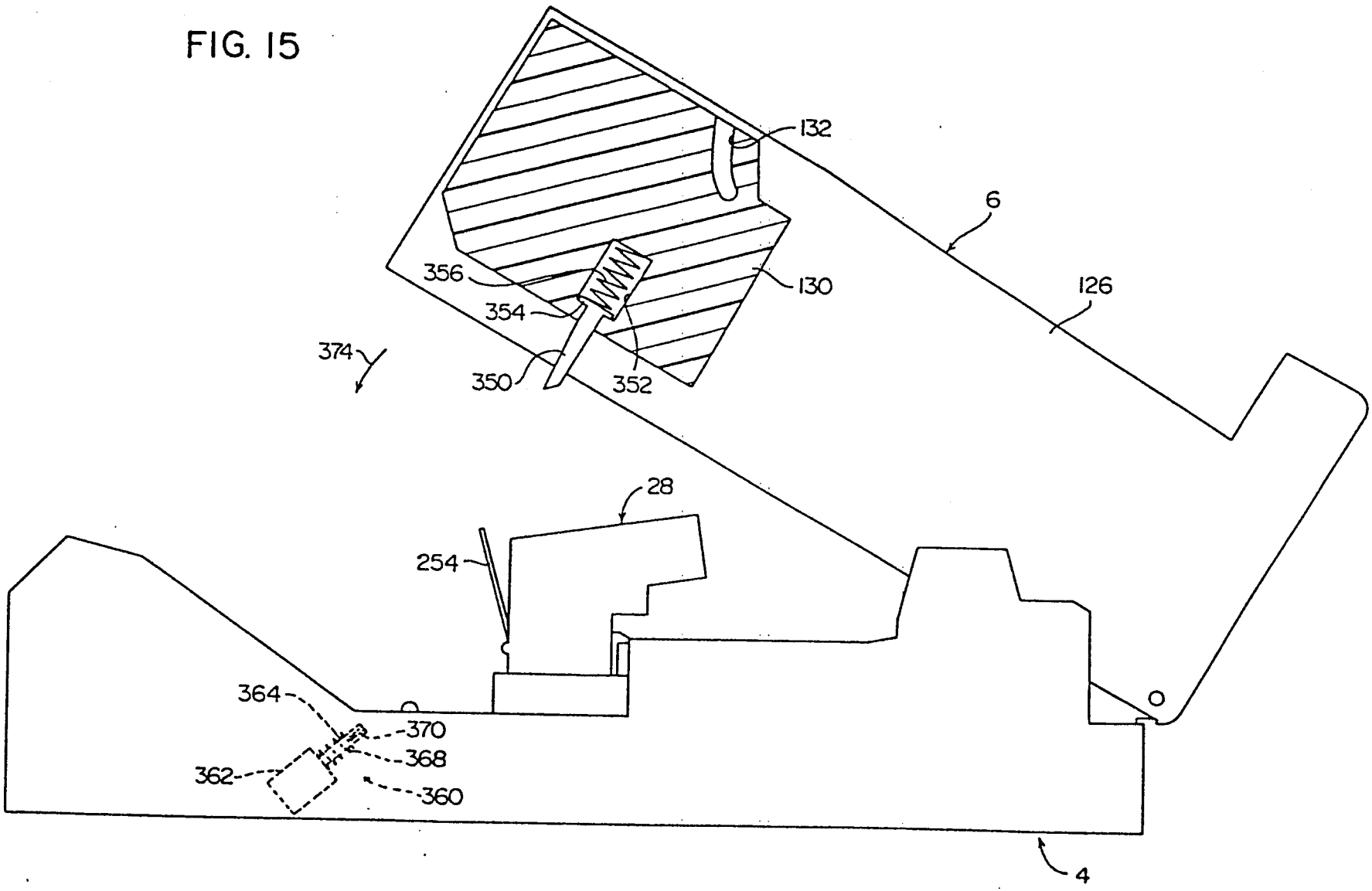
FIGS. 15 to 17 are simplified views for illustrating the opening and closing actions of the upper frame member in the laser beam printer of FIG. 1.
Figure 16:
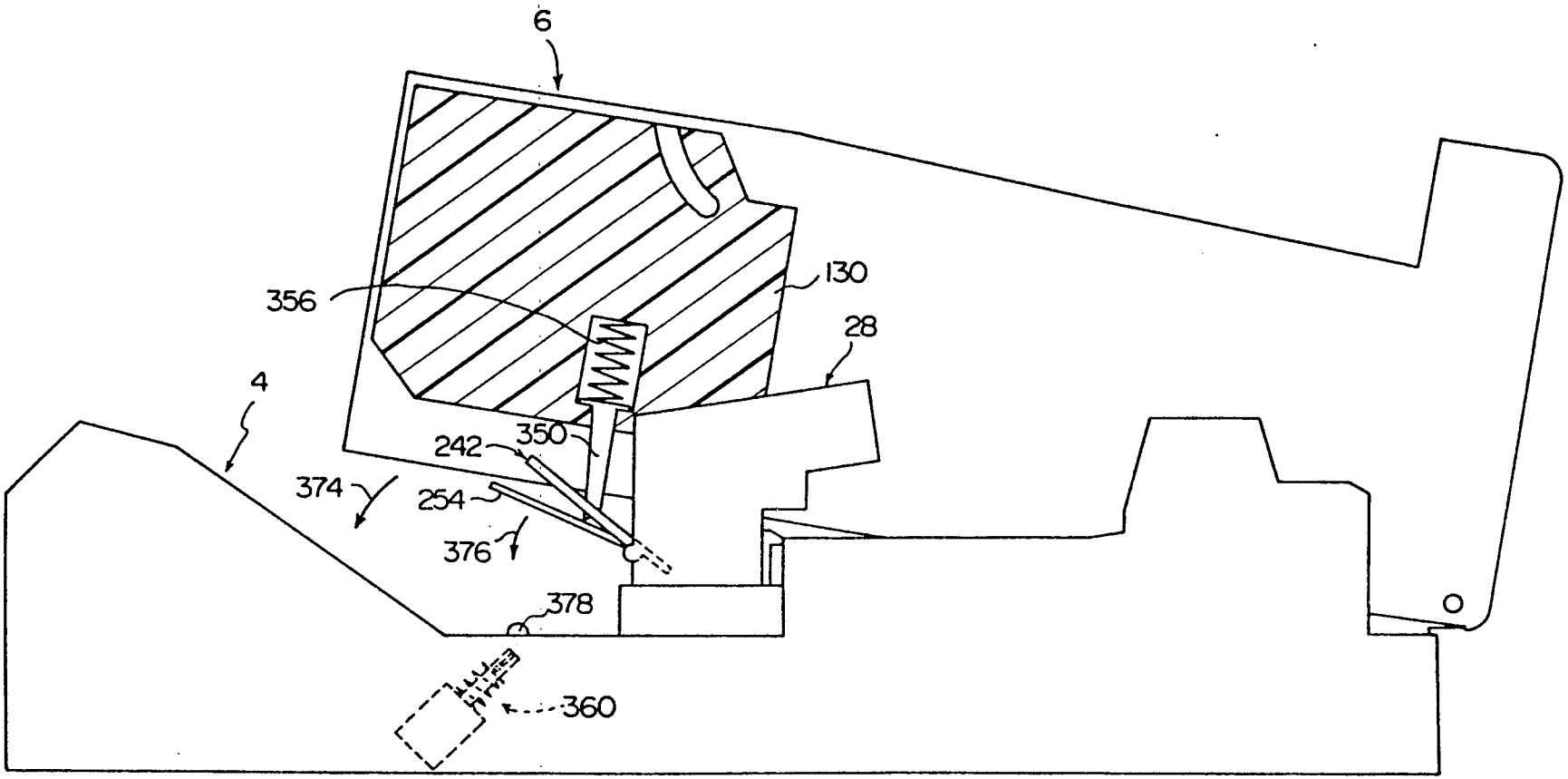
Figure 17:
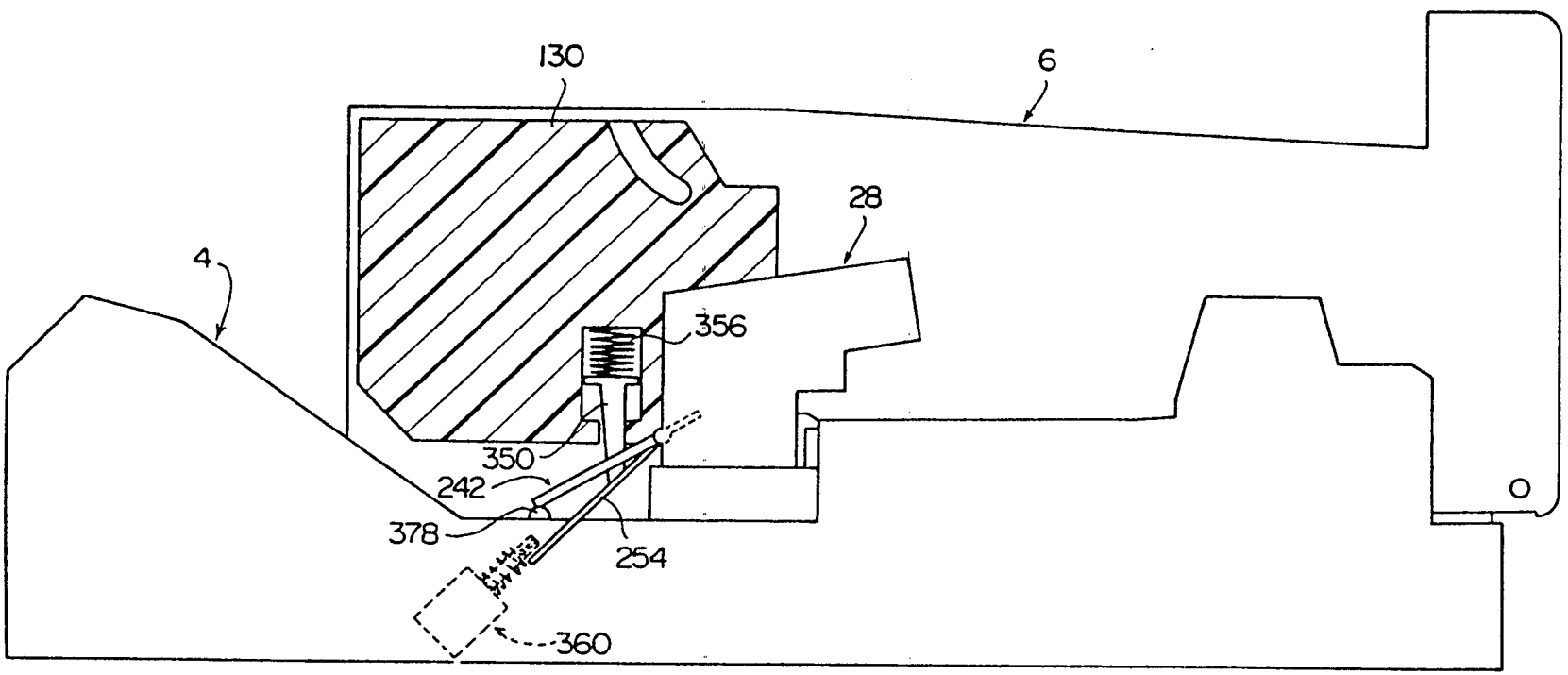

Because of the above construction, when the upper frame member 6 is pivoted from the open position shown in FIG. 15 (the position shown by a one-dot chain line in FIG. 2) in the direction shown by an arrow 374 while the second unit 28 is mounted on the lower frame member 4, the actuating member 350 provided in the upper frame member 6 comes into contact with the arm 254 of the cover 242 at the closed position. When the upper frame member 6 is further pivoted in the direction shown by arrow 374 from this state, the cover 242 is pivoted in the direction shown by an arrow 376 from the closed position via the actuating member 350 incident to the pivotal movement of the upper frame member 6. This pivotal movement is continued until the forward end portion of the cover 242 comes into contact with a contact protrusion 378 provided in the partitioning wall 86 of the lower frame member 4. Upon the contacting of the cover 242 with the contact protrusion 378, the pivoting movement of the cover 242 beyond the open position is hampered, and even if the upper frame member 6 is thereafter pivoted toward the closed position, the cover 242 does not pivot, and the actuating member 350 is moved upwardly relative to the upper frame 6 against the biasing action of the biasing spring 356. When the upper frame member 6 is thus positioned at the closed position, the biasing spring 356 presses down the arm 254 relatively strongly, and the cover 242 is accurately held at the open position.

When the upper frame member 6 is pivoted from the closed position toward the open position, the actuating member 350 is moved downwardly relative to the upper frame member 6 by the action of the biasing spring 356 in the early stage of its pivoting, and thereafter, the cover 242 is pivoted from the open position toward the closed position by the action of a biasing spring (not shown) incident to the pivoting movement of the upper frame member 6. When the upper frame member 6 is held at the open position, the actuating member 350 of the upper frame member 6 moves away from the arm 254 and is positioned above the arm 254. Consequently, the cover 242 is held at the closed position.

Figure 18:
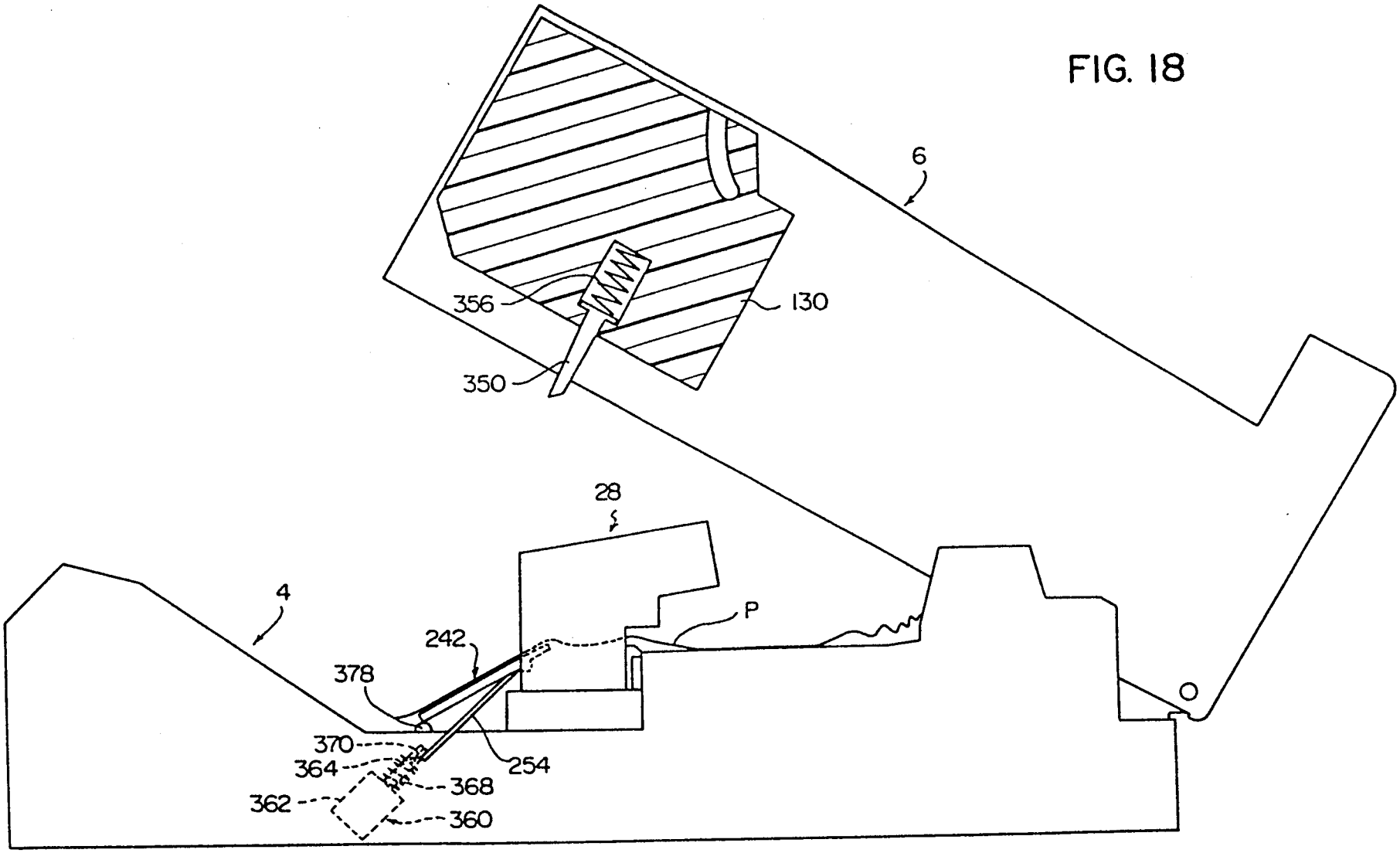
FIG. 18 is a simplified view showing one example in which jamming occurs in the laser beam printer of FIG. 1.

When the upper frame member 6 is at the closed position and the electromagnetic solenoid 360 is energized, the protrusion 370 provided in the output rod 364 comes into the moving path of the protrusion 372 and is positioned above it, as can be seen from FIGS. 18 and 19. Accordingly, when the upper frame member 6 is pivoted toward the open position in this state, and the cover 242 has pivoted to some extent from the open position toward the closed position, the protrusion 372 provided in the arm 254 comes into contact with the protrusion 370 of the output rod 364, and as a result, the cover 242 rests at the open position.

In the illustrated embodiment, the electromagnetic solenoid 360 is normally in the deenergized state, and becomes energized in the event that jamming of a sheet material happens in the conveying passage. This energized state is adapted to be canceled when the jamming sheet material has been removed and then a reset switch is depressed.

VARIOUS OPENING-CLOSING OPERATIONS

To mount the first unit 26, the upper cover 136 is held at the open position as shown in FIG. 1, and the space above the left end portion in FIGS. 1 and 2 of the upper frame member 6 is kept open. Then, the supporting pin 120 of the first unit 26 is positioned in the receiving portion 132 defined in the upper frame member 6 and the first unit 26 and the second unit 28 are set up in the positional relationship shown in FIG. 2. Thereafter, the upper cover 136 is pivoted counterclockwise in FIG. 1 and held at the closed position. As a result, the first unit 26 is held at the position shown in FIG. 2, and the magnetic brush mechanism 106 of the developing device 20 and the rotating drum 14 of the second unit 28 are maintained in a predetermined positional relationship.

The first unit 26 can be detached by holding the upper cover 136 at the open position described above, lifting the first unit, and detaching the supporting pin 120 from the corresponding receiving portion 132.

Accordingly, the first unit 26 can be mounted and detached by only opening and closing the upper cover 136 constituting part of the upper frame member 6, and therefore by the relatively easy and simple opening and closing operations of the upper cover 136.

To mount the second unit 28, the upper frame member 6 is opened and held at the open position as shown by a one-dot chain line in FIG. 2. Then, the bottom of the second unit 28 is mounted on the fixing depressed portion 298 of the fixing block portion 296 through the space between the lower frame member 4 and the upper frame member 6. The second unit 28 is in the state shown by a solid line in FIG. 6 before it is used. Specifically, the cover 242 is at the closed position to close the introduction opening. The cover 244 is also at the closed position and closes the withdrawal opening. The seal member 292 is applied to the upper wall 158 of the unit frame 152 to cover the openings 236 and 240 in the upper wall 158 substantially completely. Accordingly, before use, all of the various openings defined in the unit frame 152 are closed to shut off external light and avoid its arrival at the rotating drum 14. Thus, the deterioration of the electrostatographic material of the rotating drum 14. The second unit 28 in this state is mounted on the lower frame member 4. As is apparent from the foregoing description, the various openings defined in the unit frame 152 are closed when it is mounted on the lower frame member 4. Accordingly, the surface of the electrostatographic material does not make contact with part of the machine or the operator's finger at the time of mounting, and the electrostatographic material is prevented from undergoing injury. When the second unit 28 is mounted on the lower frame member 4, the cover 244 is held at the open position, and the withdrawing opening is kept open.

In use, the sealing member 292 is removed from the unit frame 152 and then the upper frame member 6 is held at the closed position. When the seal member 292 is removed, the openings 236 and 240 are kept open. When the upper frame member 6 is held at the closed position, the cover 242 is held at the open position by the action of the actuating member 350, and the introduction opening is open. Thus, the state shown by a solid line in FIG. 2 is created, and the image-forming process becomes possible.

The second unit 28 so mounted may be detached by holding the upper frame member 6 at the open position, and then lifting the second unit 28 through the space formed between the upper frame member 6 and the lower frame member 4. When the upper frame member 6 is held at the open position, the cover 242 is held at the closed position. When the second unit 28 is moved upwardly, the cover 244 is also held at the closed position. Thus, the electrostatographic material is prevented from undergoing injury at the time of detaching operation.

Accordingly, the introduction opening and the withdrawing opening can be opened at the time of performing the image-forming process without performing a special opening-closing operation. Furthermore, when the process unit is detached from the main body 2 of the machine, the introduction opening and the withdrawing opening can be closed, and the electrostatographic material can be prevented effectively from injury and deterioration. Since in the illustrated embodiment, when the upper frame member 6 is brought to the open position, the cover 242 for the introduction opening is held at the closed position. Hence, when the operator's hand is put into the main body 2 of the machine through the space between the upper frame member 6 and the lower frame member 4, it does not erroneously contact the electrostatographic material of the rotating drum 14.

To remove the sheet material P which has jammed in the conveying passage, the upper frame member 6 is held at the open position as shown in FIG. 18. In the case of jamming, the electromagnetic solenoid 360 is energized, and therefore, by contacting of the protrusion 370 of the output rod 364 with the protrusion 372 of the arm 254, the cover 242 for the introduction opening is continued to be held at the open position. Accordingly, when the sheet material jams as shown in FIG. 18, the sheet material can be easily removed by pulling the rear end portion of the sheet material extending upstream from the second unit 28 to an upstream side. If the cover 242 is designed not to be holdable at the open position, the cover 242 pivoting to the closed position causes the sheet material to wrap about the rotating drum 14. Consequently, the electrostatographic material is likely to be injured by the jamming sheet material, and the removal of the jamming sheet material is not easy.

After the jamming sheet material has been removed, the upper frame member 6 is held at the closed position, and then, the reset switch (not shown) is depressed.

Accordingly, the sheet material that has jammed up can be easily removed As can be understood from FIG. 2, the first unit 26 including the developing device 20 and the optical unit 30 are mounted on the upper frame member 6, and the second unit 28 including the rotating drum 14 and the cleaning device 24 is mounted on the lower frame member 4. Accordingly, the upper frame member 6 and the constituent elements mounted on it are relatively light in weight, and the upper frame member 6 can be easily moved for closing and opening. When the upper frame member 6 is held at the open position, the first unit 26 moves upwardly, and the left side of the second unit 28 is widely open in FIG. 2, and through the open space, the sheet material that has jammed up can be easily removed. The first unit 26 and the second unit 28 are separately constructed, and this offers the following advantage. Generally, the lives of the rotating drum 14 (especially its electrostatographic material) and the developing device 20 are not substantially the same, and the life of the developing device 20 is several times longer. Accordingly, if the developing device 20 and the rotating drum 14 are mounted on the same unit frame, and the unit is adapted to be replaced, the developing device 20 is discarded wastefully. But if the developing device 20 and the rotating drum 14 are constructed as separate units, only that unit of which service life comes to an end may be discarded, and the developing device 20 and the rotating drum 14 can be used effectively until their service lives come to an end.

MODIFIED EXAMPLES

FIGS. 20 to 25 show modified examples of the second unit and its related elements. In these drawings, substantially the same parts as those in FIGS. 1 to 19 are designated by the same reference numerals.

Figure 20:
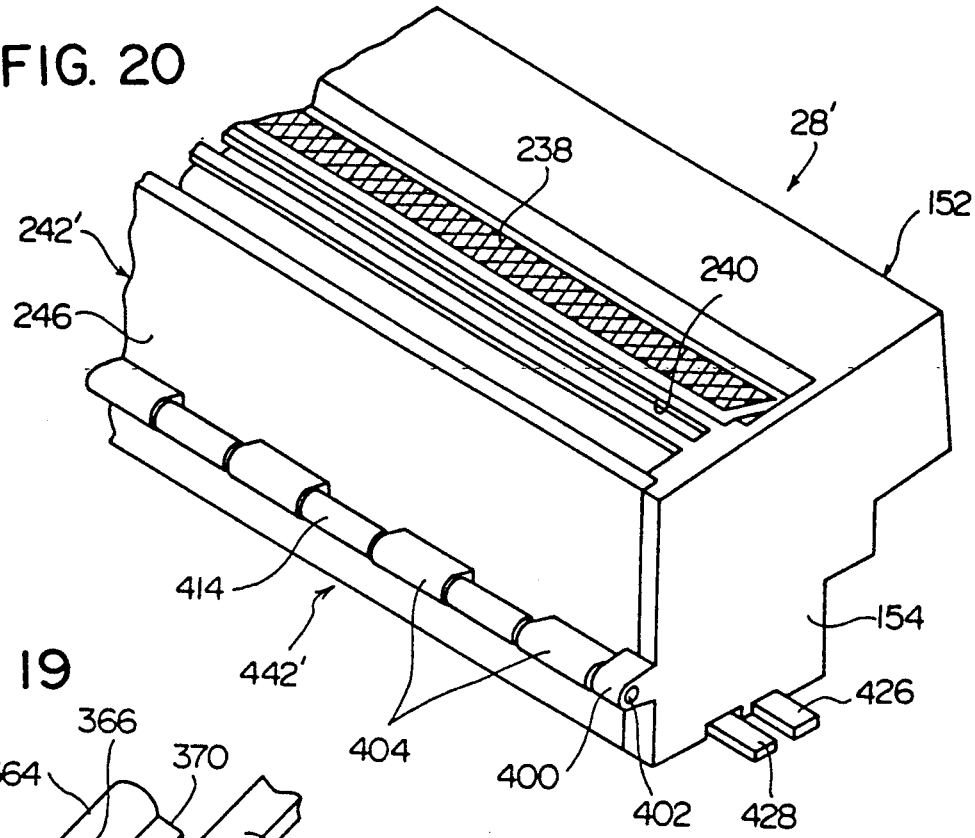
FIG. 20 is a perspective view showing part of a modified example of the second unit.
Figure 21:
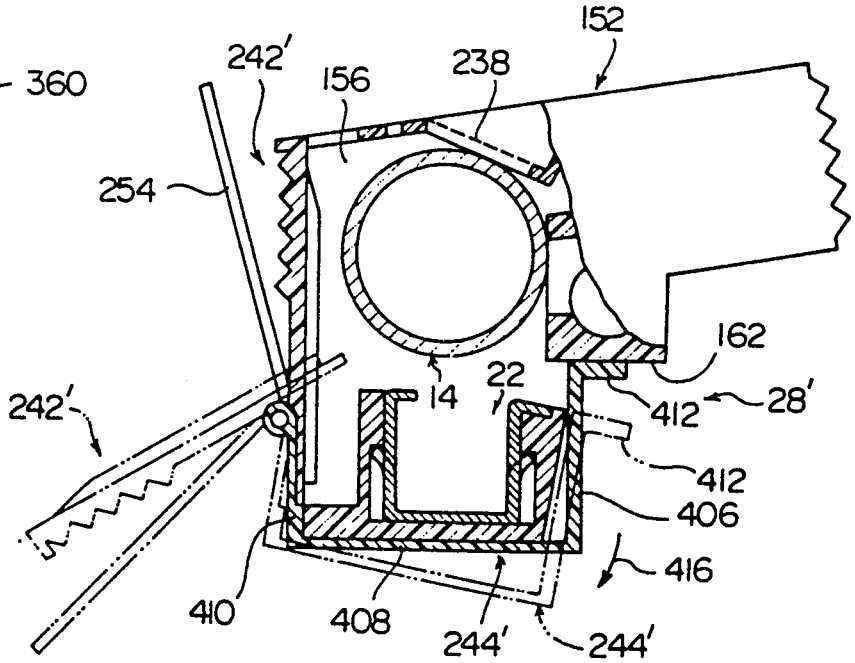
FIG. 21 is a sectional view of the modified example of the second unit.

In these modified examples, an improvement is made in the cover 242' and the cover 244'. With reference mainly to FIGS. 20 and 21, protrusions 400 (one of which is shown in FIG. 20) projecting to the left are provided in the left end portions of the end walls 154 and 156 of the unit frame 152, and a shaft 402 is fixed between and across the projecting portions 400. A plurality of engaging portions 404 spaced from each other longitudinally are provided in the base portion of the main body 246 of the cover 242'. Each of the engaging portions 404 has a nearly semicircular hook portion with an open under surface By bringing these hook portions into engagement with the shaft 402, the cover 242' is mounted so as to be free to pivot between a closed position (the position shown in FIG. 20 and by a solid line in FIG. 21) and an open position (shown by a one-dot chain line in FIG. 21). A biasing spring (not shown) for biasing the cover 242' toward the closed position is provided in the cover 242'. The cover 244' for the withdrawing opening has an opening-closing portion 406 for opening and closing the withdrawing opening, a connecting portion 408 extending from the lower end of the opening-closing portion 406 to the left in FIG. 21, and a fixing portion 410 extending upwardly from the left end of the connecting portion 408, and is disposed so as to cover the outside of the bottom of the unit frame 152. A guiding protrusion 412 extending in the conveying direction of the sheet material is provided at one end of the cover 244', namely at the upper end of the opening-closing portion 406, and a plurality of engaging portions 414 spaced from each other in the direction from right bottom to left top in FIG. 20 are provided in the other end of the cover 244', namely at the upper end of the fixing portion 410, so that they are positioned alternately with the engaging portions 404 of the cover 242'. Each of the engaging portions 414 has a nearly semicircular hook portion with an open upper surface. By bringing these hook portions into engagement with the shaft 402, the cover 244' is mounted so as to be free to pivot between the closed position (the position shown in FIG. 20 and by a solid line in FIG. 21) and the open position (the position shown by a one-dot chain line in FIG. 21). When the cover 244' is at the closed position, the connecting portion 408 of the cover 244' extends substantially parallel to, and along, the under surface of the bottom wall of the unit frame 152, and the upper end of the opening-closing portion 406 comes into contact with part (the under surface of that site defining the toner recovery chamber) of the right side wall 162 of the unit frame 152. Thus, the withdrawing opening is closed by the opening-closing portion 406. On the other hand, at the open position displaced from the closed position in the direction shown by an arrow 416 (FIG. 21), the upper end of the opening-closing portion 406 is away from the aforesaid part of the right side wall 162 and is positioned downwardly by a predetermined distance. Hence, the withdrawing opening is open as is required. In the illustrated embodiment, a triangular depressed portion is defined in the right end portion in FIG. 21 of the bottom wall of the unit frame 152 to permit the cover 244' to pivot as described above. A biasing spring (not shown) is also provided in this cover 244' in order to bias it toward the closed position.

In relation to the above construction of the cover 244', the second unit 28 and its related elements are constructed as follows:-

Figure 22:
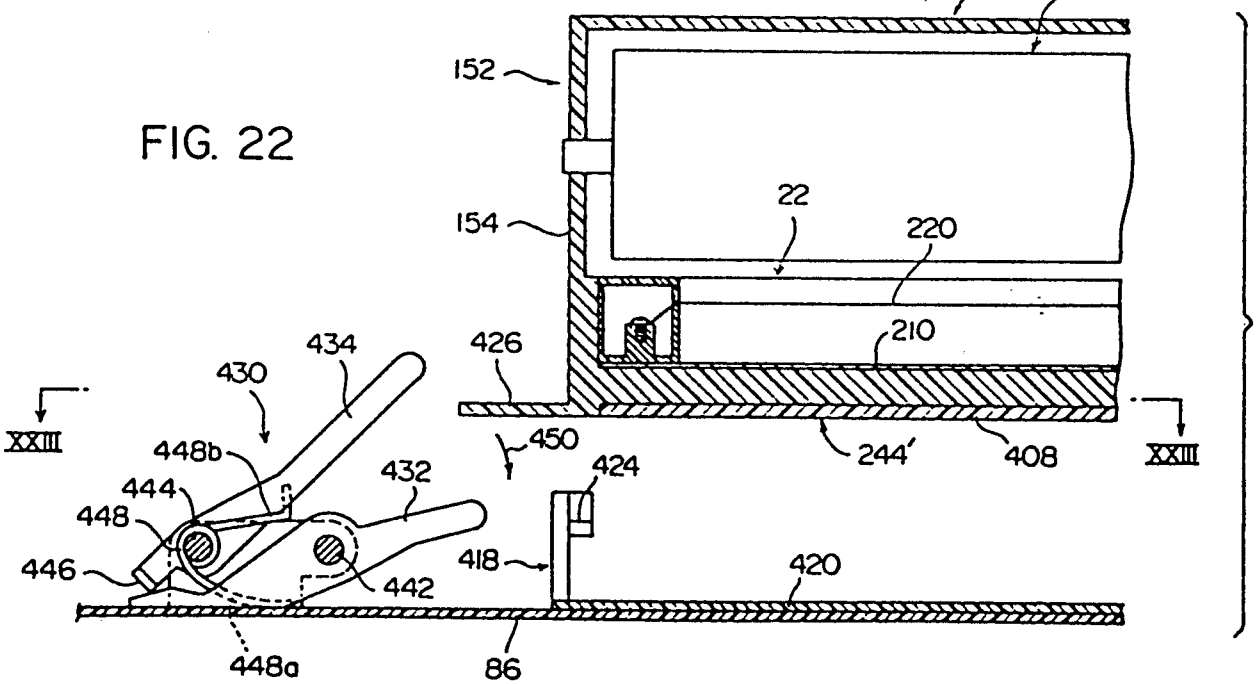
Figure 25:
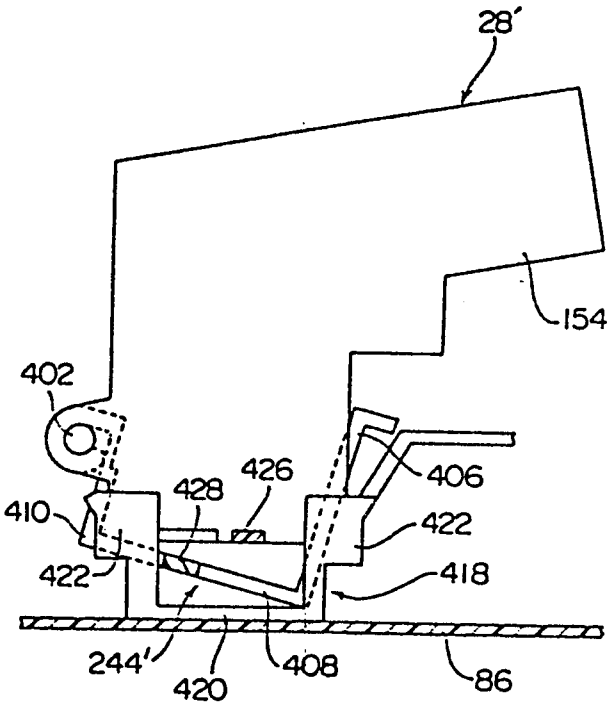

A supporting member 418 is provided at a predetermined site of the partitioning wall 86 of the lower frame member 4. With reference to FIGS. 22 and 25, the supporting member 418 has a plate-like fixing portion 420 fixed to the upper surface of the partitioning wall 86. Supporting leg portions 422 (two of which are shown in FIG. 25) are provided in the four corner portions of the fixing portion 420. The four corner portions of the bottom of the second unit 28' are supported by the receiving portions 424 (FIG. 22) having a rectangular shape in cross section defined in the upper end portions of the supporting leg portions 422. By this supporting, a space is created between the partitioning wall 86 and the bottom wall of the second unit 28', and permits the above pivoting of the cover 244'.

An outwardly projecting actuating protrusion 462 is provided at the lower end of the end wall 154 of the unit frame 152. A protrusion 428 is also provided in the connecting portion 408 of the cover 244'. The protrusion 428 projects outwardly through a cut formed in the end wall 154 (see FIGS. 20 and 23 also).

Figure 23:
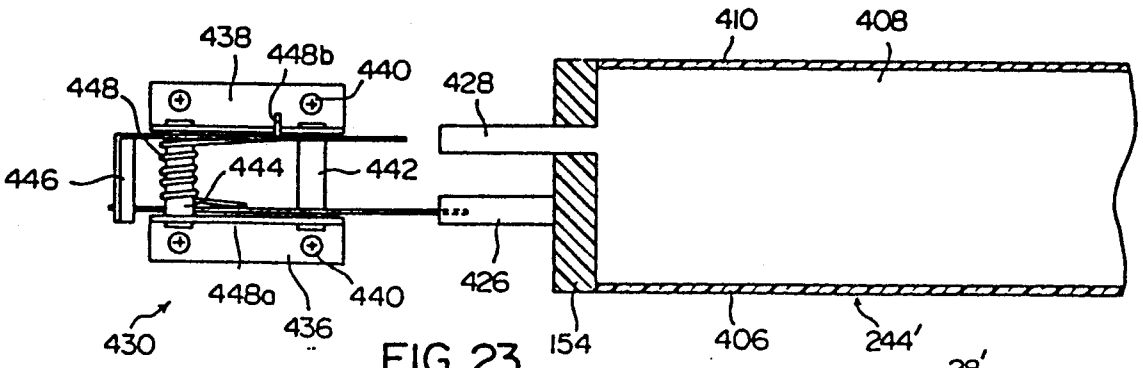
FIGS. 22 to 25 are sectional views for illustrating the actions in the mounting of the modified example of the second unit on the lower frame member.

An actuating mechanism 430 is provided with regard to the actuating protrusion 426 and the protrusion 428. With reference to FIGS. 22 and 23, the illustrated actuating mechanism 430 is provided with a first lever 432 and a second lever 434. A pair of supporting brackets 436 and 438 spaced from each other are fixed to the upper surface of the partitioning wall 86 of the lower frame member 4 by means of fixing screws 440 (FIG. 23). A first lever 432 is pivotably mounted between one end portions of these supporting brackets 436 and 438 via a shaft member 442, and a second lever 434 is mounted pivotably between the other end portions of these brackets 436 and 438 via a shaft member 444. One end portion of the first lever 432 extends toward the supporting member 418, and its other end portion extends downwardly of the shaft member 444. One end portion of the second lever 434 also extends toward the supporting member 418, and an interlocking protrusion 446 extending toward the other end portion of the first lever 432 is integrally provided in the other end portion of the second lever 434. Furthermore, a torsion coil spring 448 (omitted in FIG. 24) is fitted over the shaft member 444, and its one end portion **448*a* engages the partitioning wall 86. Its other end portion 448*b* engages one end portion of the second lever 434. The torsion coil spring 448 elastically biases the second lever 434 counterclockwise in FIG. 22 to bring the interlocking protrusion 446 of the second lever 434 into press contact with the other end portion of the second lever 434. Usually, the first lever 432 and the second lever 434 are maintained in the state shown in FIGS. 22 and 23 by the contacting of the other end portion of the first lever 432 with the upper surface of the partitioning wall 86. The one end portion of the first lever 432 extends upwardly in a relatively gently inclined fashion, and the one end portion of the second lever 434** extends upwardly in a relatively very sharp inclined fashion.

The structures of this modified example are substantially the same as in the illustrated embodiment shown in FIGS. 1 to 19, and its detailed description will be omitted herein.

Figure 24:
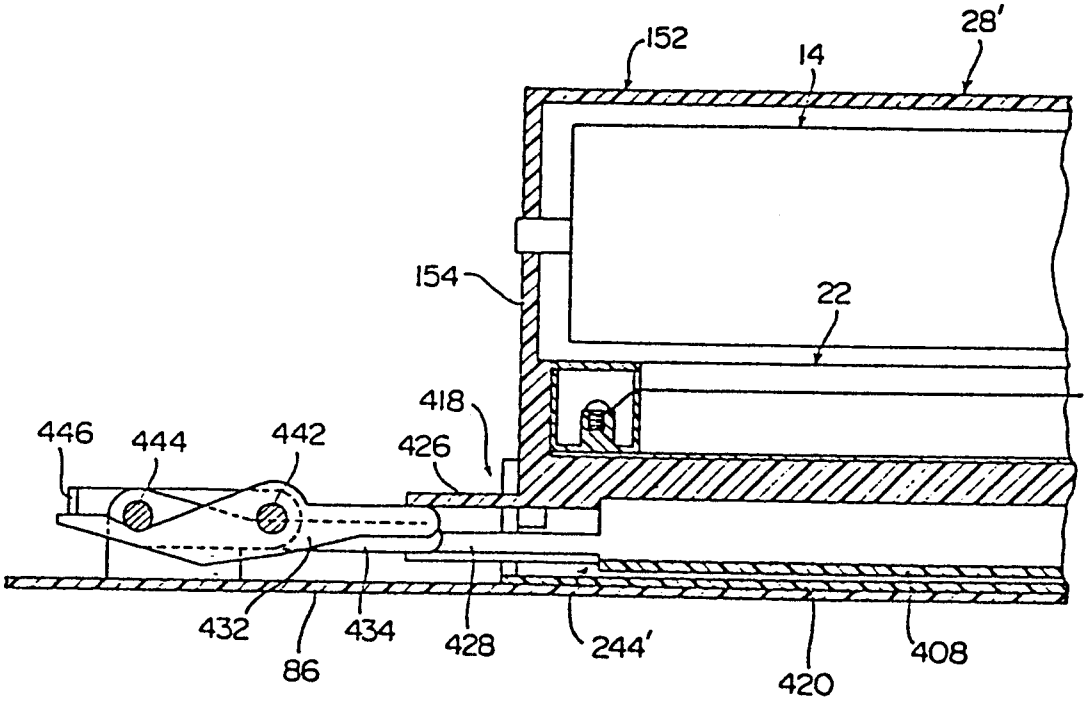

In the modified examples, when the second unit 28' is positioned above the supporting member 418 as shown in FIGS. 22 and 23 and moved downwardly, the actuating protrusion 426 of the end wall 154 comes into contact with one end portion of the first lever 432 to cause it to pivot in the direction shown by an arrow 450 (FIG. 22). As a result, the other end portion of the first lever acts on the second lever 434 via the interlocking 446 to cause the second lever 434 to also in the direction of arrow 450. When the second unit 28' is further lowered, the second lever 434 greatly pivots via the first lever 432 and the one end portion of the second lever 434 acts on the protrusion 428 of the cover 244' to cause the cover 244' to pivot downwardly with the shaft member 402 as a fulcrum. When the second unit 28' is mounted on the receiving portion 424 of the supporting member 418, the first lever 432 and the second lever 434 pivot until they become nearly horizontally as shown in FIGS. 24 and 25. As a result, the cover 244' for the withdrawing opening pivots until it is brought to the open position. Consequently, the withdrawing opening defined in the second unit 28' is opened in the required manner.

On the other hand, when the second unit 28' is detached from the receiving portion 424 of the supporting member 418, the first lever 432 departs from the protrusion 426 of the end wall 154, and the second lever 434 departs from the protrusion 428 of the cover 244', as shown in FIGS. 22 and 23. As a result, the cover 244' is held at the closed position by the action of the biasing spring (not shown).

Accordingly, in the modified examples, too, the withdrawing opening is opened by mounting the second unit 28' on the lower frame member 4, and the withdrawing opening will be closed by detaching it from the lower frame member 4. Thus, the same result as in the above-mentioned specific embodiments can be achieved.

While some specific embodiments of the image-forming machine of the invention have been described with regard to a laser beam printer as one example of the image-forming machine, it should be understood that the invention is not limited to these specific embodiments, and various changes and modifications are possible without departing from the spirit and scope of this invention described and claimed herein.

What is claim is:

1. An image-forming machine comprising a supporting structure including a lower frame member and an upper frame member mounted on the lower frame member so as to be free to pivot between an open position and a closed position, and a process unit including an image-bearing means having an electrostatographic material and a developing device for developing a latent electrostatic image formed on the surface of the electrostatographic material to a toner image, the process unit being mounted on the supporting structure, wherein the process unit comprises a first unit including the developing device and a second unit including the image-bearing means, a cleaning device for removing the toner remaining on the surface of the electrostatographic material and a transfer corona discharger for transferring the toner image formed on the surface of the electrostatographic material to a sheet material, the first unit being adapted to be mounted on the upper frame member and the second unit being adapted to be mounted on the lower frame member, and when the upper frame is pivoted toward the open position, the upper frame member and the first unit are moved upwardly, and thereby the space between the first unit and the second unit is kept open.

2. An image-forming machine comprising a main body and a process unit to be mounted detachably on the main body, wherein the process unit includes an image-bearing means having an electrostatographic material and a transfer corona discharger for transferring the toner image formed on the surface of the electrostatographic material to a sheet material, a transfer zone existing between the image-bearing means and the transfer corona discharger, an introduction opening for introducing a sheet material into the transfer zone is formed in one surface of the process unit, and a withdrawing opening for withdrawing the sheet material conveyed through the transfer zone is formed in the other surface of the process unit, and an opening-closing cover for opening or closing the opening is provided in at least one of the introduction opening and the withdrawing opening.

3. The image-forming machine of claim 2 in which a cover movable between a closed position at which it closes the introduction opening and an open position at which it keeps the introduction opening open is disposed at the introduction opening, and said cover is held at the open position when the machine forms an image, and when the process unit has been detached from the main body, the cover is held at the closed position.

4. The image-forming machine of claim 3 in which the main body is provided with a supporting structure comprising a lower frame member and an upper frame member mounted on the lower frame member so as to be free to pivot between an open position and a closed position; when the upper frame member is held at the closed position while the process unit is mounted on the supporting structure, part of the upper frame member acts on the cover for the introduction opening and thus is positioned at the open position; and when the upper frame member is held at the open position, the action of said part of the upper frame member is canceled, and thus the cover is held at the closed position.

5. The image-forming machine of claim 4 in which the machine further comprises an open position holding means for holding the cover for the introduction opening at the open position; when the open position holding means is in the deenergized state, its actuating portion recedes from the moving path of the cover for the introduction opening; thus when the upper frame member is brought to the open position from the closed position, the cover is held at the closed position from the open position; and when the open position holding means is energized, the actuating portion projects into the path of movement of said cover whereby the cover for the introduction opening continues to be held at the open position by the action of the actuating portion.

6. The image-forming machine of claim 5 in which the open position holding means is energized when jamming occurs in the sheet material in part of the conveying passage for the sheet material, and as a result, the cover for the introduction opening is held at the open position by the action of the open position holding means.

7. The image-forming machine of claim 3 in which the cover for the introduction opening, when it is at the open position, defines part of the passage for conducting the sheet material toward the transfer, zone.

8. The image-forming machine of claim 2 in which a cover for the withdrawing opening which is free to move between a closed position at which it closes the withdrawing opening and an open position at which it opens the withdrawing opening is disposed in the withdrawing opening, and said cover is held at the open position when the process unit is mounted on the main body, and is held at the closed position when the process unit is detached from the main body.

9. The image-forming machine of claim 8 in which said cover defines part of a passage for conducting a sheet material downstream of the transfer zone when it is held at the open position.

10. An image-forming machine comprising a main body and a process unit detachably mounted on the main body, the process unit including an image-bearing means having an electrostatographic material and a unit frame for supporting the image-bearing means, the unit frame having a first opening which is an exposure opening formed in the frame unit for exposure of the electrostatographic material; wherein a cover member is mounted on the unit frame so as to be free to move between an open position at which it opens a second opening defined in a part of the unit frame and a closed position at which it covers the second opening, and a seal member is removably disposed in the exposure opening so as to cover it, part of the seal member extends from the exposure opening to the cover member and acts to hold the cover member at the closed position.

11. The image-forming machine of claim 10 in which the second opening defined in the unit frame is an introduction opening for introducing a sheet material into a transfer zone; the cover member is a cover for opening or closing the introduction opening; and part of the seal member extends from the exposure opening to the cover to hold the cover at the closed position.

12. An image-forming machine comprising a main body and a process unit detachably mounted on the main body, the process unit including an image-bearing means having an electrostatographic material and a unit frame for supporting the image-bearing means; wherein a cover member is mounted on the unit frame so that it is free to move between an open position at which it opens an opening defined in part of the unit frame and a closed position at which it covers the opening; the unit frame and the cover member each having vertically spaced protrusions to facilitate holding of the unit frame and the cover by an operator in lifting the process unit; the cover member being arranged to be held at its closed position by an operator's holding of the process unit.

13. An image-forming machine comprising a main body and a process unit and an optical unit mounted on the main body, the process unit including an image-bearing means having an electrostatographic material and a unit frame for supporting the image-bearing means, and the optical unit including an optical housing and an optical means within the optical housing for projecting light having image information onto the image-bearing means; wherein the optical unit is mounted so that it is free to pivot toward and away from the process unit about a substantially horizontally extending pivot axis;

a biasing means is provided for biasing the optical unit in a direction approaching the process unit; and by the action of the biasing means, part of the optical housing and part of the unit frame are kept in press contact with each other and the optical unit and the process unit is held in a predetermined positional relationship.

14. The image-forming machine of claim 13 in which the main body includes a supporting structure comprising a lower frame member and an upper frame member mounted on the lower frame member so as to be free to pivot between an open position and a closed position about a substantially horizontally extending pivot axis; the process unit is mounted on the lower frame member, and the optical unit is mounted on the upper frame member; and when the upper frame member is held at the closed position, the biasing means acts to bring part of the optical housing into press contact with said part of the unit frame whereby the optical unit and the process unit are held in a predetermined positional relationship.

15. The image-forming machine of claim 14 in which movement hampering means is provided in the upper frame member which hampers the downward movement of the optical unit beyond its lowered position; the optical unit is normally held at said lowered position by the action of the biasing means as a result of part of it coming into contact with the movement hampering means; and when the upper frame member is brought to the closed position from the open position, said part of the optical housing comes into contact with said part of the unit frame, and the optical housing is slightly elevated from the lowered position against the action of the biasing means, and consequently, the optical housing and the unit frame are held in press contact with each other by the action of the biasing means.

16. An image-forming machine comprising a supporting structure comprising a lower frame member and an upper frame member mounted on the lower frame member so as to be free to pivot between an open position and a closed position, and a process unit including an image-bearing means having an electrostatographic material and a unit frame for supporting the image-bearing means and being adapted to be mounted on the lower frame, and a charging corona discharger for applying a corona discharge to the surface of the electrostatographic material on the image-bearing means; wherein the charging corona discharger has a housing having an opening defined therein, a wire stretched taut within the housing, and a grid disposed in the opening of the housing, the housing is mounted on the upper frame member and the grid is mounted on the unit frame, when the upper frame member is held at the closed position, the housing and the grid are positioned in a predetermined positional relationship, and when the upper frame member is kept at the open position, the space between the housing and the grid is kept open.

17. A developing device detachably mounted on the main body of an image-forming machine for developing a latent electrostatic image formed on the surface of an image-forming means of the main body into a toner image, in which a downwardly projecting supporting projecting portion is provided at the bottom of the developing device, and by detaching the developing device from the main body of the image-forming machine, the supporting projecting portion is positioned on a placing surface, the developing device being maintained substantially in the same posture as that when it is mounted on the main body of the machine, and when the developing device is mounted detachably on the main body of the machine, the supporting projecting portion defines part of a conveying passage for conveying a sheet material.

18. A developing device detachably mounted on the main body of an image-forming machine for developing a latent electrostatic image formed on the surface of an image-forming means of the main body into a toner image, in which a downwardly projecting supporting projecting portion and a plurality of guiding ribs defining part of a passage for conveying a sheet material are provided at the bottom of the developing device, the supporting projecting portion projecting downwardly beyond the lower ends of the guiding ribs and, by detaching the developing device from the main body of the image-forming machine, the supporting projecting portion is positioned on a placing surface, the developing device being maintained substantially in the same posture as that when it is mounted on the main body of the machine.

* * * * *